US007060182B2

(12) United States Patent
Erlich et al.

(10) Patent No.: US 7,060,182 B2
(45) **Date of Patent: *Jun. 13, 2006**

(54) HAND-HELD POOL CLEANER

(75) Inventors: Guy Erlich, New York, NY (US); David G. Reed, Langhorne, PA (US); Jonathan Elmaleh, Brooklyn, NY (US)

(73) Assignee: Water Tech LLC., East Brunswick, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/139,357

(22) Filed: May 27, 2005

(65) Prior Publication Data

US 2005/0279683 A1 Dec. 22, 2005

Related U.S. Application Data

(63) Continuation-in-part of application No. 10/948,031, filed on Sep. 23, 2004, now Pat. No. 6,939,460, which is a continuation of application No. 10/282,883, filed on Oct. 29, 2002, now Pat. No. 6,797,157.

(51) Int. Cl.
*E04H 4/16* (2006.01)

(52) U.S. Cl. ..... 210/169; 210/238; 210/416.2; 15/1.7; 134/168 R

(58) Field of Classification Search ..... 210/94, 210/136, 169, 232, 238, 416.1, 416.2, 435, 210/452; 15/1.7; 4/490, 496; 134/168 R
See application file for complete search history.

(56) References Cited

U.S. PATENT DOCUMENTS 2,827,268 A * 3/1958 Staaf ..... 366/264
3,091,340 A * 5/1963 Pansini ..... 210/354
3,513,977 A * 5/1970 Bellinson ..... 210/94
3,755,843 A * 9/1973 Goertzen et al. ..... 15/1.7
3,758,276 A * 9/1973 Bond et al. ..... 422/265
3,803,658 A * 4/1974 Raubenheimer ..... 15/1.7
3,886,616 A * 6/1975 Hayes ..... 15/1.7
4,193,228 A * 3/1980 Bowler ..... 451/359
4,212,088 A * 7/1980 Goettl et al. ..... 4/490
4,443,899 A * 4/1984 Johnson ..... 4/490
4,449,265 A * 5/1984 Hoy ..... 15/1.7
4,624,274 A * 11/1986 Norton ..... 134/111
4,651,376 A * 3/1987 Ford ..... 15/1.7
4,801,376 A * 1/1989 Kulitz ..... 210/123
4,935,980 A * 6/1990 Leginus et al. ..... 15/1.7
4,962,559 A * 10/1990 Schuman ..... 15/1.7
5,028,321 A * 7/1991 Stone et al. ..... 210/167
5,111,129 A * 5/1992 Schuman ..... 320/107
5,135,647 A * 8/1992 Childers ..... 210/136
5,137,623 A * 8/1992 Wall et al. ..... 210/169
5,450,644 A * 9/1995 Berman ..... 15/1.7
5,554,277 A * 9/1996 Rief et al. ..... 210/94
5,569,371 A * 10/1996 Perling ..... 210/85
5,842,243 A * 12/1998 Horvath et al. ..... 15/1.7

(Continued)

*Primary Examiner*—Fred G. Prince
(74) *Attorney, Agent, or Firm*—Abelman, Frayne & Schwab

(57) ABSTRACT

A hand-held, electrically-powered pool cleaner includes a body and a nozzle for suctioning pool water. The body has a filter, an impeller and motor, rechargeable batteries, and a handle for carrying the body and for maneuvering the nozzle along a surface being cleaned the surface. The impeller draws pool water through the nozzle and the filter to remove debris water. A filter housing disposed between the nozzle and the body accumulates the filtered debris. The body optionally includes a pole attachment member to receive the free end of a pole for maneuvering the cleaner from outside of the pool.

20 Claims, 25 Drawing Sheets

U.S. PATENT DOCUMENTS 5,951,854 A * 9/1999 Goldberg et al. ..... 210/85
5,954,071 A * 9/1999 Magliocca ..... 134/109
6,238,555 B1 * 5/2001 Silveri et al. ..... 210/143
6,248,232 B1 * 6/2001 Stoner ..... 210/136
6,294,084 B1 * 9/2001 Henkin et al. ..... 210/143
2001/0004974 A1 * 6/2001 Ekenback et al. ..... 210/143
2001/0032809 A1 * 10/2001 Henkin et al. ..... 210/143
2001/0050093 A1 * 12/2001 Porat ..... 134/8
2002/0002750 A1 * 1/2002 Phillipson et al. ..... 15/1.7
2004/0074024 A1 * 4/2004 Bavoso ..... 15/1.7

* cited by examiner

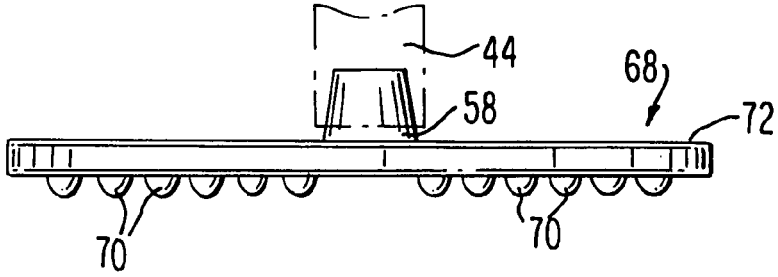
FIG. 6
FIG. 7
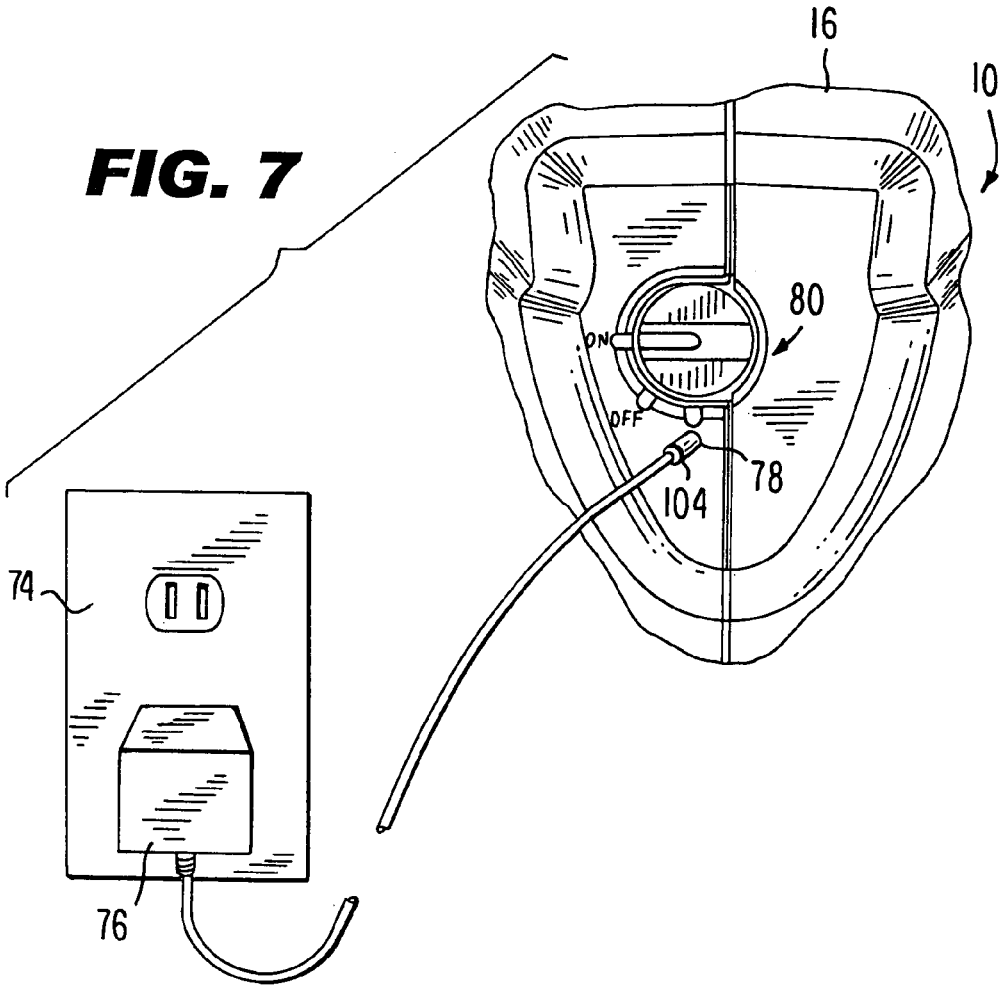

FIG. 25
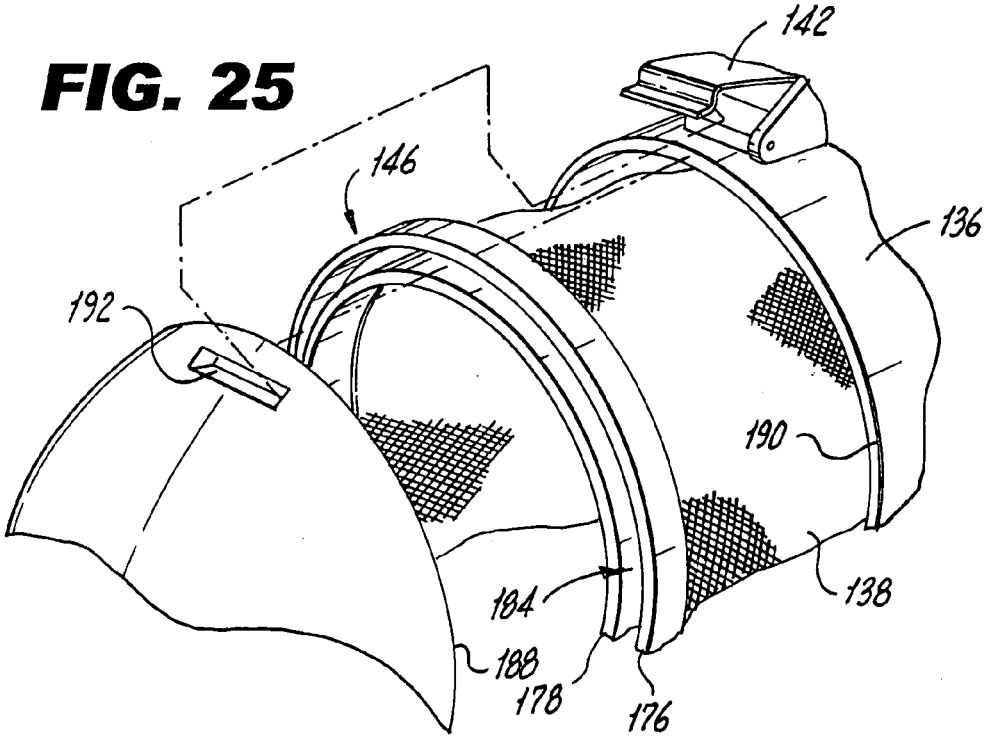
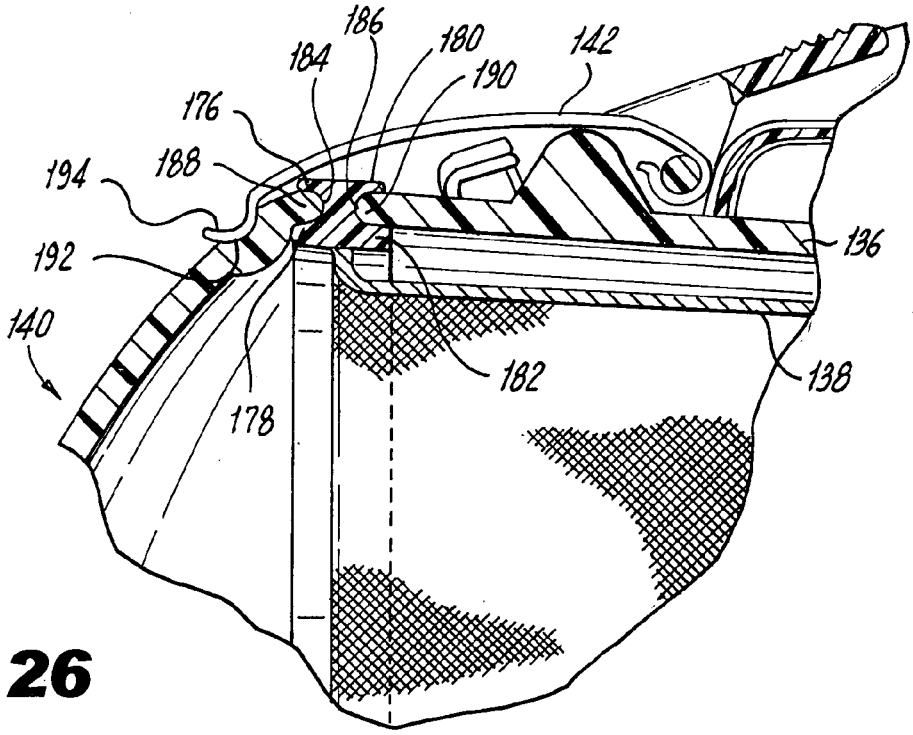
FIG. 26

FIG. 27
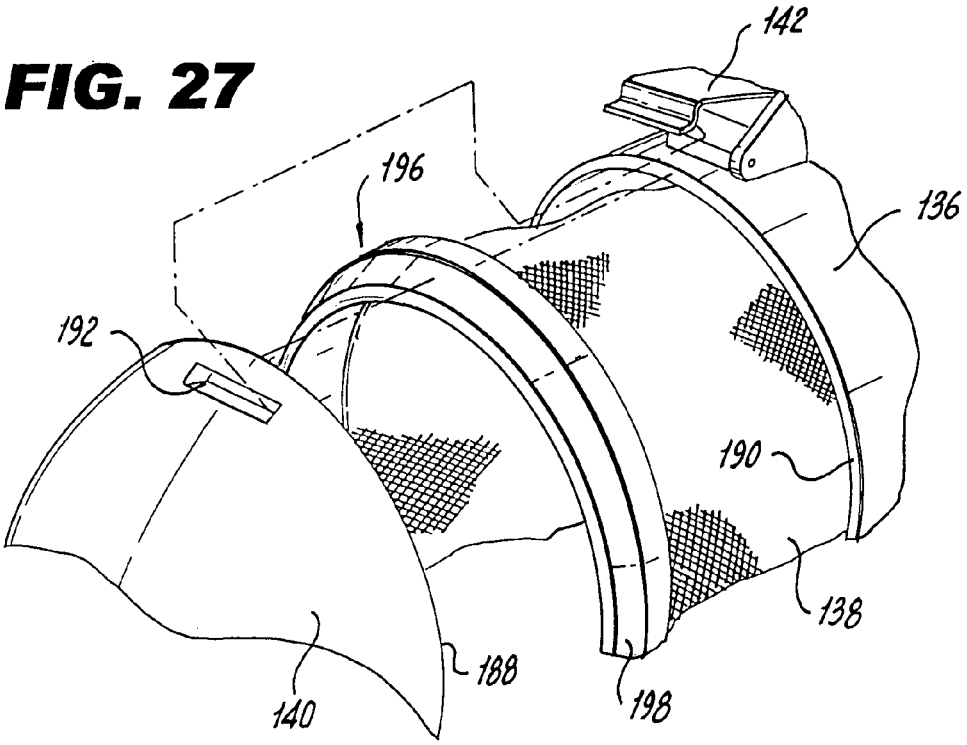
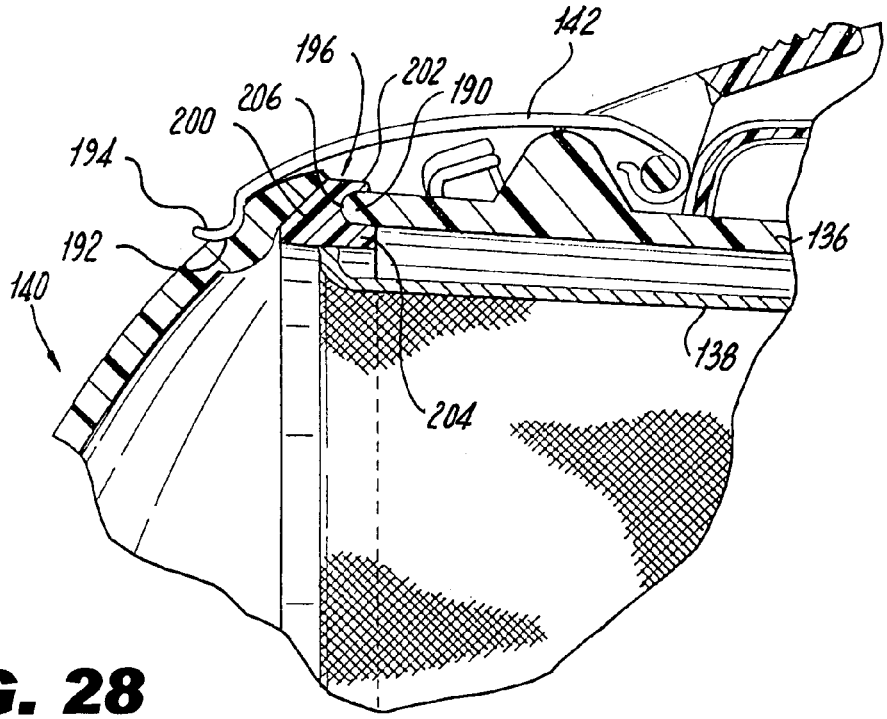
FIG. 28

HAND-HELD POOL CLEANER

CROSS-REFERENCE TO RELATED APPLICATIONS

This disclosure is a continuation-in-part application of U.S. Ser. No. 10/948,031, filed Sep. 23, 2004, now U.S. Pat. No. 6,939,460, issued Sep. 6, 2005; which is a continuation of U.S. Ser. No. 10/282,883, filed Oct. 29, 2002, now U.S. Pat. No. 6,797,157, issued Sep. 28, 2004, which is incorporated herein by reference in its entirety. This disclosure is also a continuation-in-part application of U.S. Ser. No. 11/139,093, filed May 26, 2005 and entitled ADAPTABLE NOZZLE ATTACHMENT FOR POOL CLEANER, which is incorporated herein by reference in its entirety.

FIELD OF THE INVENTION

This invention relates to an electrical pool cleaning apparatus, and in particular to a hand-held pool cleaner.

BACKGROUND OF THE INVENTION

Pool cleaning apparatus are known for passing over the surfaces of pools to remove dirt and debris and filter the pool water. Such pool cleaning apparatus are typically bulky. A lightweight and hand-held pool cleaner would be advantageous to allow a user to easily manipulate the pool cleaner over the surfaces of a pool, spa or pond.

Known pool cleaning apparatus require power cords extending through the water to outside electrical outlets. A portable pool cleaner powered by batteries would be advantageous to eliminate the need for power cords.

In battery-powered devices capable of being used underwater, the ability to recharge the batteries with an externally disposed charging port is necessary. Although the device being used underwater is not being charged, such externally disposed charging ports can be exposed to the water, risking a short in the device and so potentially damaging the device. A water-tight charging port would be advantageous for battery-powered devices that are immersed in water, such as pool cleaning apparatus.

BRIEF SUMMARY OF THE INVENTION

A highly portable hand-held pool cleaner is powered by rechargeable batteries, and includes body and intake nozzle for suctioning pool water. The body houses a filter, an impeller attached to an electric motor, and includes a handle for carrying the body and for manipulating the nozzle over a surface of a pool to clean the surface. The impeller suctions pool water through the nozzle and the filter retains dirt and debris removed from the pool water. A filter housing disposed between the nozzle and the body accumulates the filtered debris. A pole attachment member, mounted to the body, releasably receives the free end of a pole in secure attachment for manipulating the cleaner from a remote location adjacent the surface of the pool to that is to be cleaned.

BRIEF DESCRIPTION OF THE SEVERAL VIEWS OF THE DRAWINGS

Preferred embodiments of the invention are described hereinbelow with reference to the drawings wherein:

FIG. 6 is a side elevational view of an alternative embodiment of a nozzle attachment;

FIG. 7 is a partial rear elevation view of the pool cleaner in a charging mode with an electrical outlet;

FIG. 25 is a top front side perspective view of a seal of a filter of the pool cleaner of FIG. 18;

FIG. 26 is a side cross-sectional view of the seal of FIG. 25;

FIG. 27 is a top front side perspective view of an alternative embodiment of the seal of the filter of the pool cleaner of FIG. 18;

FIG. 28 is a side cross-sectional view of the seal of FIG. 27;

DETAILED DESCRIPTION OF THE INVENTION

Figure 1:
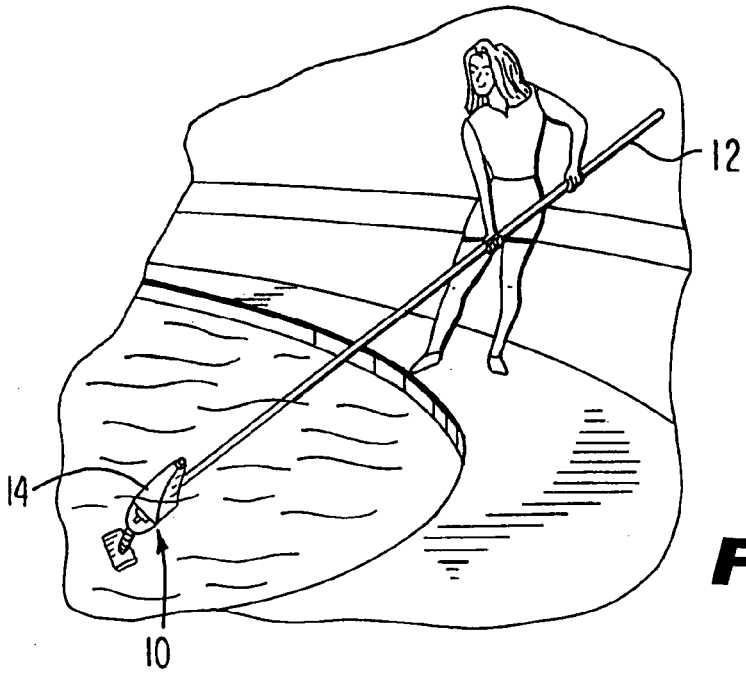
FIG. 1 illustrates one mode of operating a pool cleaner in operation in accordance with one embodiment of the present invention.

As described herein, FIG. 1 illustrates a pool cleaner 10 in accordance with the present invention in one mode of operation. The pool cleaner 10 is battery-powered, and capable of suctioning particulate material as well as debris of a relatively large size, such as leaves, from the surfaces to be cleaned. The pool cleaner 10 includes a filter for filtering the suctioned material and one or a plurality of discharge ports for expelling the filtered water.

In a first mode of operation shown in FIG. 1, the pool cleaner 10 is attachable to a pole 12, allowing the user to clean the pool surfaces while standing outside the pool. In a second, hand-held mode of operation, the pool cleaner 10 includes an integral handle 14, allowing the user immersed with the pool cleaner 10 in the pool to grasp and orient the pool cleaner 10 and so to manipulate the pool cleaner 10 over the surfaces.

As shown in the side elevational view of the pool cleaner 10 includes a body 16 with projecting handle 14. The body 16 can be composed of molded plastic with an egonometric streamlined shape, e.g., a smooth and curvilinear surface providing low resistance in the water. The handle is preferably integrally formed from the molded plastic to allow the pool cleaner 10 to be hand-held and to be easily carried and manipulated. The body 16 includes hollow sections 18, shown in FIGS. 8–11, which fill with water during immersion, so the pool cleaner 10 is not buoyant after full immersion. The pool cleaner 10 configured to be of essentially neutral buoyancy so that it be manipulated underwater with relative ease in any orientation along any horizontal, vertical or curved surfaces that is being cleaned.

A pole attachment member 20 extends from the body 16, allowing the extended pole 12 to be securely, but removably attached to the pool cleaner 10 for use in the first mode of operation shown in FIG. 1. The pole 12 can be attached to the pole attachment member 20 by any known fastening devices, such as removable screws with corresponding apertures. Alternatively, the pool attachment member 20 can include spring-loaded buttons and detents 22, such as shown in FIG. 2, or other curved surfaces for removably attaching the pole 12 in a friction fit.

A plurality of discharge water discharge ports or apertures 24 are present in the body 16, allowing filtered water to be returned to the pool, and for allowing water to flow into and out of the hollow portions. In a preferred embodiment illustrated in FIG. 2, the water discharge ports 24 are symmetrically oriented to expel the filtered water in a direction generally perpendicular to the longitudinal axis 56 of the pole attachment member 20, preventing water jet pressure of the expelled water exiting from any single water expulsion port 24 from causing the pool cleaner 10 to move in an unintended direction. Accordingly, the pool cleaner 10 is easy to manipulate when in use, and responds primarily to the movement determined by the user by use of the handle 14 or the pole 12 when attached to the pole attachment member 20.

A filter housing 26 is mounted to the fore of the body 16 for accumulating the debris suctioned into the pool cleaner 10. In a preferred embodiment, the filter housing 26 is composed of transparent plastic, allowing the user to see the amount of debris suctioned and the remaining capacity of the filter housing 26 and thereby to determine the need for emptying the accumulated debris.

Figure 2:
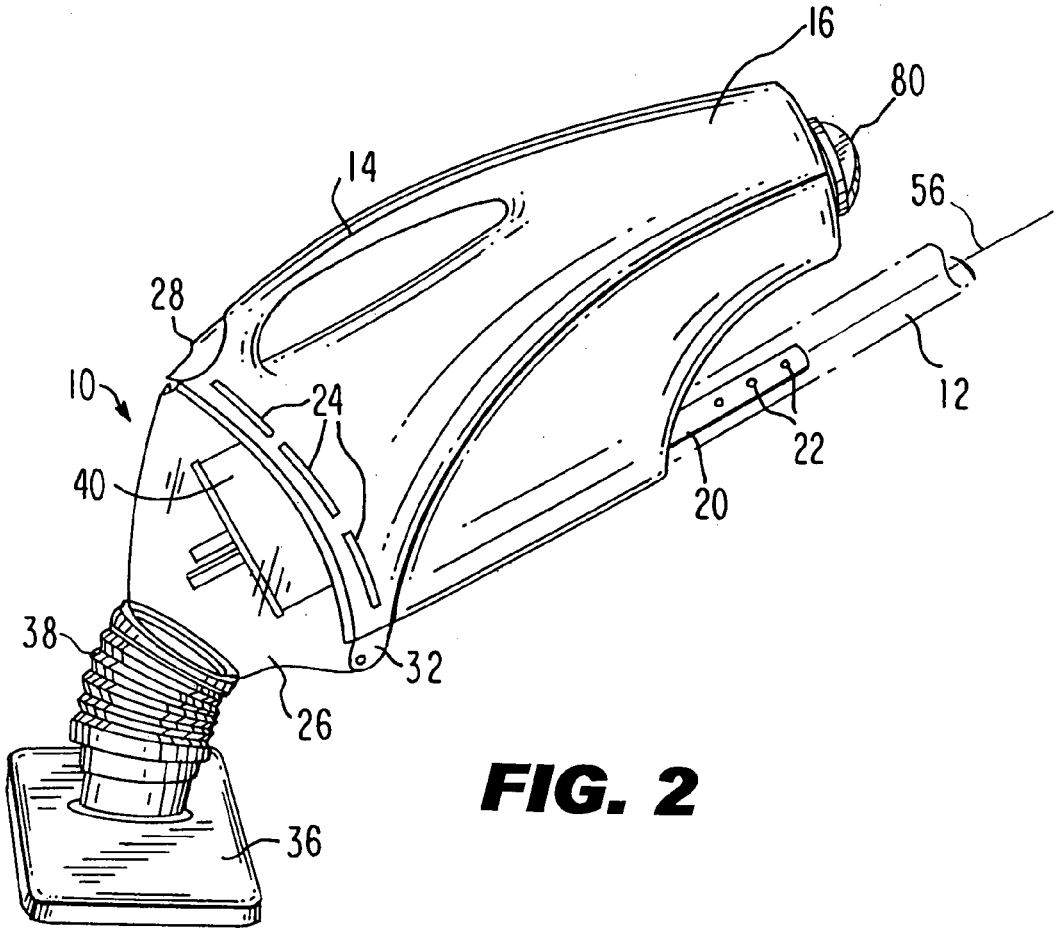
FIG. 2 is a side elevational view of the pool cleaner illustrated in FIG. 1.
Figure 3:
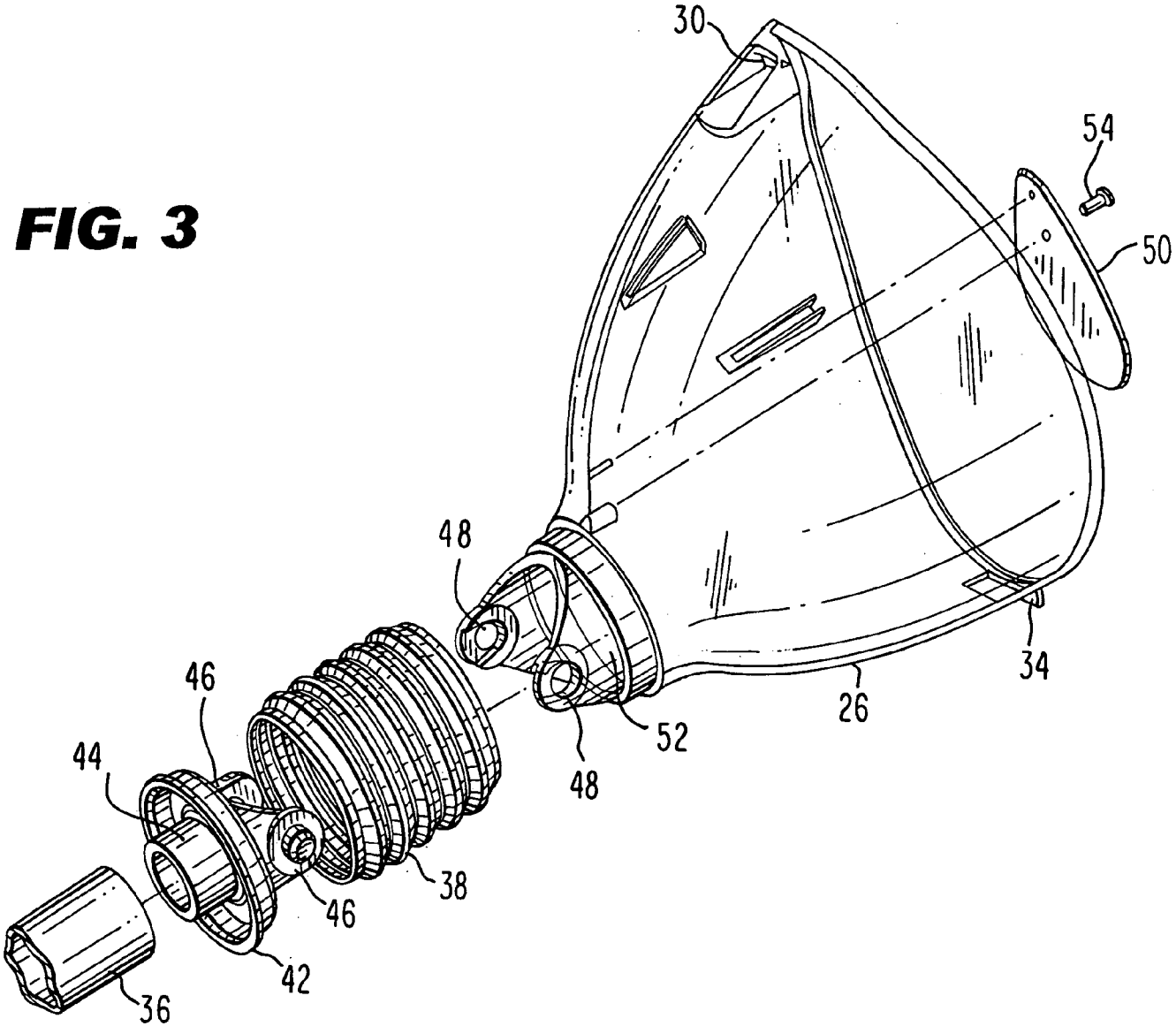
FIG. 3 is a side perspective view of a nozzle end of the pool cleaner with parts separated.

As also shown in FIG. 2, the filter housing 26 is attached to the body 16 by a latch-and-hinge arrangement. A releasable latch 28 fits into a latch aperture 30, as best shown in FIG. 3, allowing the filter housing 26 to pivot away from the body 16 about a hinge 32 to permit emptying of debris from the filter housing 26. In one embodiment, the hinge 32 permanently affixes the filter housing 26 to the body 16 in a pivoting configuration. In another embodiment, the hinge can be a removable hinge, engaging a complementary hinge member 34 on the filter housing 26, shown in FIG. 3, in which the filter housing 26 is capable of being detached from the hinge 32 after being pivoted to a predetermined angle.

During operation of an internally disposed impeller mechanism, described below, pool water containing debris is suctioned through the nozzle attachment 36 and the ribbed or bellows cover 38 forms a conduit positioned at the fore of the filter housing 26 and forms a watertight seal at its points of attachment to the nozzle and housing. The cover 38 can be formed of molded polymeric material, and optionally provided with wire reinforcement. The impelled water passes through a filter 40 in the filter housing 26, the filtered water then passes through and out of the water discharge ports 24.

As shown in FIG. 3, the nozzle end of the pool cleaner 10 includes a nozzle pivot interface 42 and the cover 38 disposed between the filter housing 26 and the nozzle attachment 36. The nozzle pivot interface 42 includes a tubular member 44 to which a particular selected nozzle attachment 36 is removably secured, for example, by a friction fit or by means of locking lugs. In one embodiment, the nozzle pivot interface 42 has a predetermined width for the attachment to standard, commercially available nozzle attachments, such as components with widths of about one inch (about 2.5 cm). The nozzle pivot interface 42 includes protruding circular pegs 46 for receiving circular apertures 48 at the fore end of the filter housing 26.

The flexible bellows 38 is disposed between the nozzle pivot interface 42 and the filter housing 26, allowing the nozzle pivot interface 42 and the nozzle attachment 36 mounted thereto to pivot about the circular pegs 46, and so permitting the pool cleaner 10 to be easily manipulated over and around curved surfaces in the pool.

A check or flap valve 50 composed of flexible material can be mounted at the entry port 52 of the filter housing 26 using known fastening devices, such as a rivet 54. The suctioning water jet pressure from the impeller mechanism opens the flap valve 50, and cessation of the water jet force by turning off the pool cleaner 10 closes the flap valve 50 to prevent the entrained debris from flowing out of the filter housing 26 and back through the nozzle.

Referring again to FIG. 2, in a preferred embodiment, the longitudinal axis 56 of the pole attachment member 20 is aligned to pass through the nozzle pivot interface 42, for example, at the position of the circular pegs 46. Such alignment directs the forces imparted from the user to be directed toward the nozzle pivot interface 42 and the nozzle attachment 36 mounted thereto, to provide greater control of the movement of the nozzle end of the pool cleaner 10 over the pool surfaces and towards debris to be suctioned.

Figure 4:
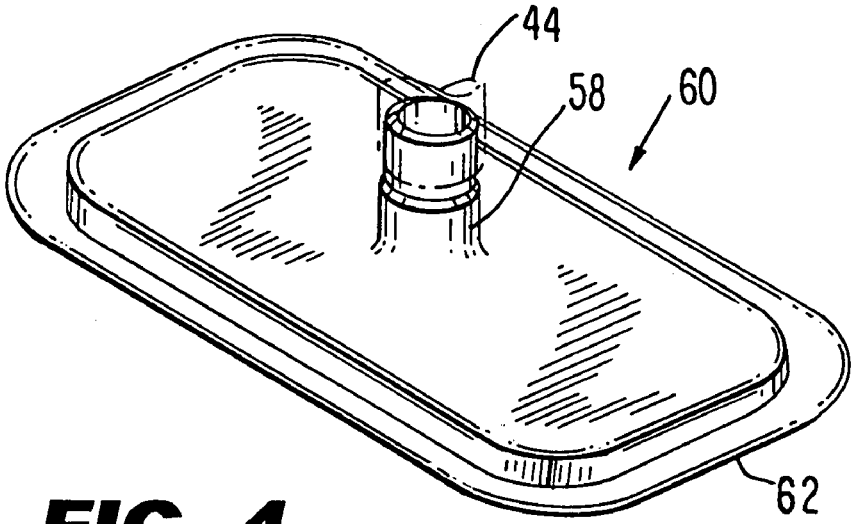
FIG. 4 is a top perspective view of one embodiment of a nozzle attachment.
Figure 5:
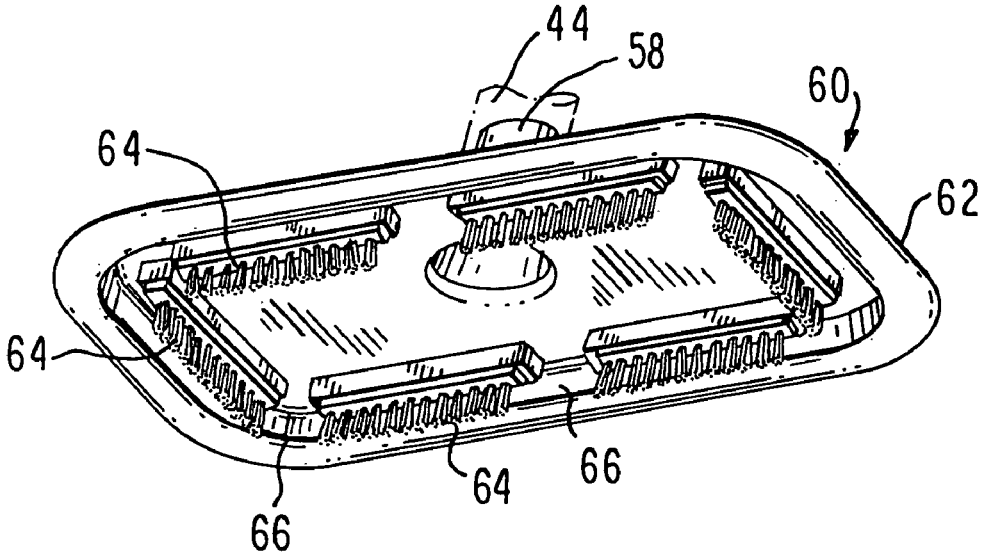
FIG. 5 is an underside perspective view of the nozzle attachment of FIG. 4.

The nozzle attachments 36 described herein include a tubular member 58 removably attachable to the nozzle pivot interface 42, as shown in FIGS. 4–6. The nozzle attachments 36 can optionally include other features. For example, the nozzle attachments 36 can be identical to, or adapted from known nozzle attachments for use with vacuum cleaners. Alternatively, the nozzle attachment 36 can be custom-designed for use in cleaning pools, spas, ornamental outdoor ponds and the like.

As shown in FIGS. 4–5, a custom-designed pool cleaner 60 can include a tubular member 58 and a base 62 having a plurality of spaced brushes 64. The brushes 64 dislodge dirt and debris from the pool surface, allowing the pool cleaner 10 to suction up the dislodged debris. By spacing the brushes 64 to having predetermined gaps 66 therebetween, the velocity of the suctioning water is increased through the gaps 66 to increase the effectiveness of the intake of debris.

In an alternative embodiment shown in FIG. 6, the nozzle attachment 68 can include protrusions 70 on a base 72, to prevent the suctioning effect of the pool cleaner 10 from causing the base 72 to be flush with the pool surfaces, and so impeding movement of the pool cleaner 10.

In use, the pool cleaner 10 is adapted to operate for long periods of time using batteries, and preferably rechargeable batteries, for operating a motor and pump or water impeller mechanism. Referring now to FIG. 7, the pool cleaner 10 is shown in a charging configuration with an electrical outlet 74, in which an electrical interface 76, such as an AC/DC converter, plugs into the electrical outlet 74, and also plugs into a charging port 78 in the rear of the pool cleaner 10. The pool cleaner 10 can be controlled using an operating switch 80 which can be moved between ON and OFF positions. In a preferred embodiment, the operating switch 80 also includes a CHARGING position in which the pool cleaner 10 is off, preventing the pool cleaner 10 from being activated in the water while plugged into an electrical outlet 74, to thereby avoid dangerous electrocution conditions.

Figure 8:
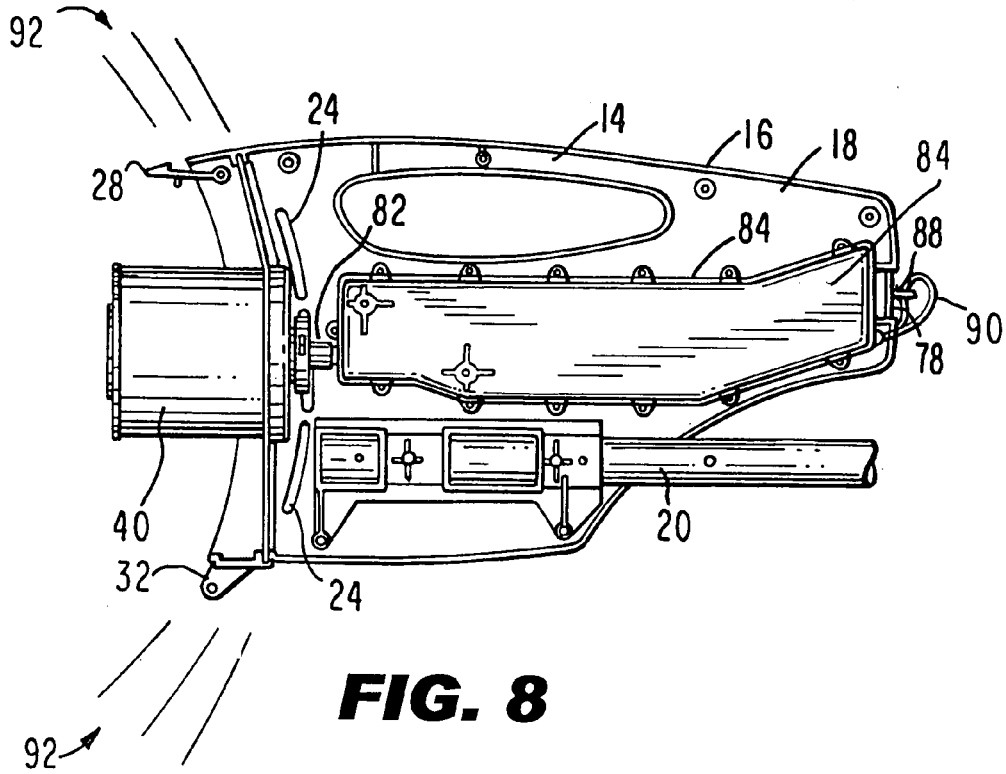
FIG. 8 is a first side cross-sectional view of the body of the pool cleaner of FIG. 2.
Figure 9:
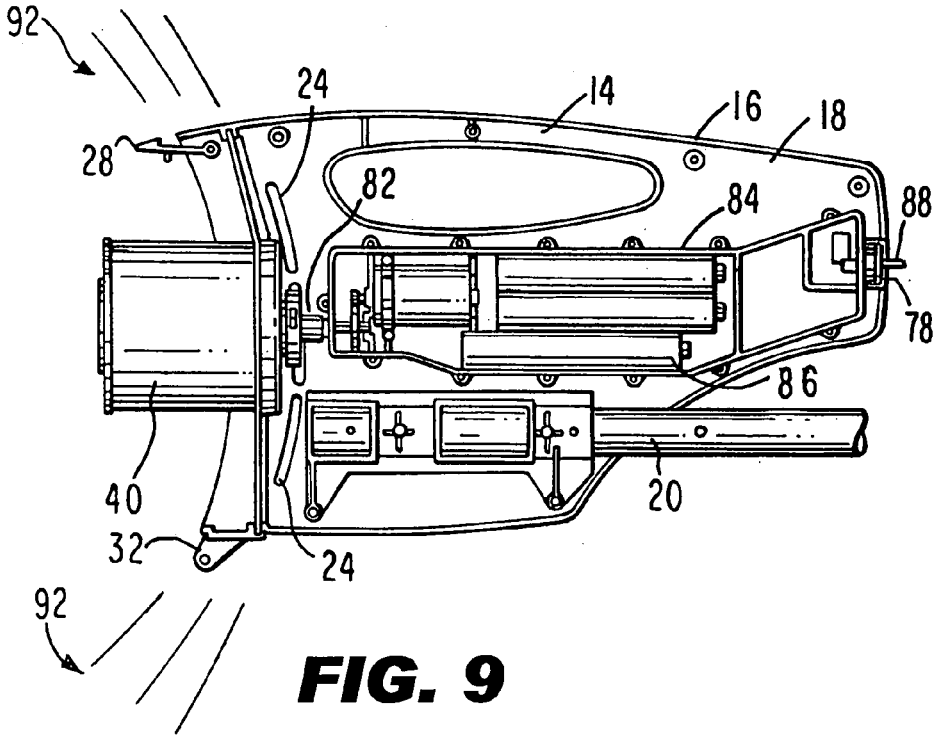
FIG. 9 is a second side cross-section view of the body of the pool cleaner of FIG. 2.
Figure 10:
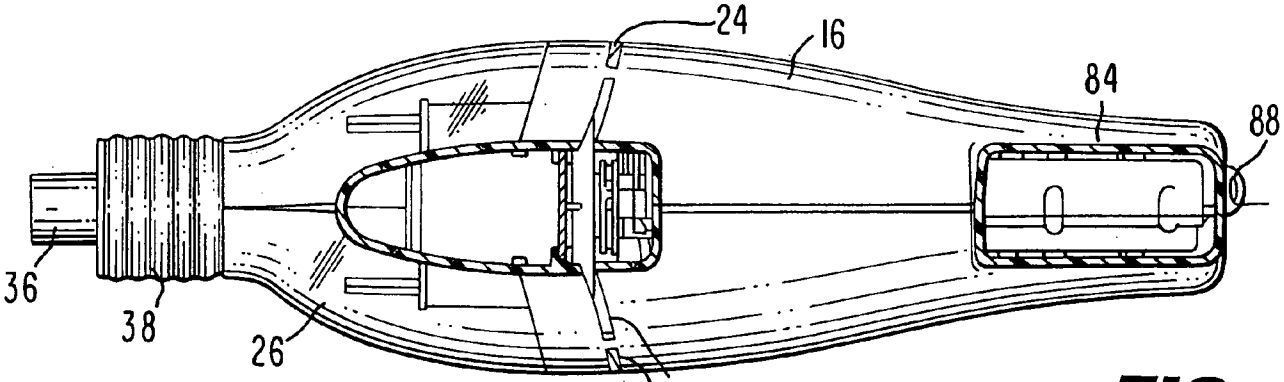
FIG. 10 is a top cross-sectional view of the pool cleaner of FIG. 2.

Referring now to FIGS. 8–10, the pool cleaner 10 is shown in cross-sectional views, illustrating the impeller mechanism 82 disposed behind the filter 40 and electrically connected to the battery pack 84 having at least one battery 86. The battery pack 84 is electrically connected to the charging port 78. The impeller mechanism 82 is any known type of device for causing a suctioning movement of water through the filter 40 and out through the water expulsion ports 24. The battery pack 84 is disposed in an air-tight section within the body 16 which extends to the charging port 78. In one embodiment, the charging port 78 can include a removable cap 88 which is loosely attached to the body 16 by a wire 90 or other fastening device, such that the removable cap 88 cannot be lost or separated from the pool cleaner 10.

As shown in FIGS. 8–9, the impeller mechanism 82 causes the filtered water to be expelled in multiple water streams 92 having a symmetry to avoid hydraulic forces that could induce lateral movement of the pool cleaner 10 in any single direction.

Figure 11:
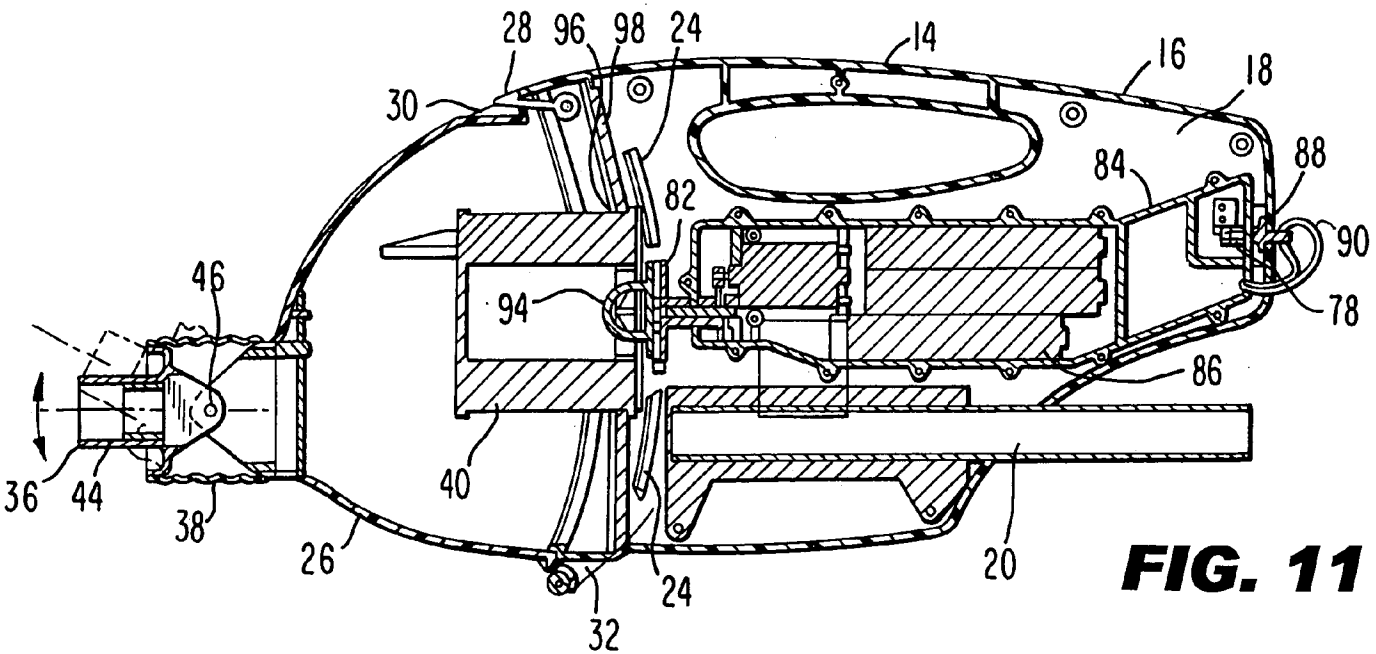
FIG. 11 is a side cross-sectional view of the pool cleaner of FIG. 2.
Figure 12:
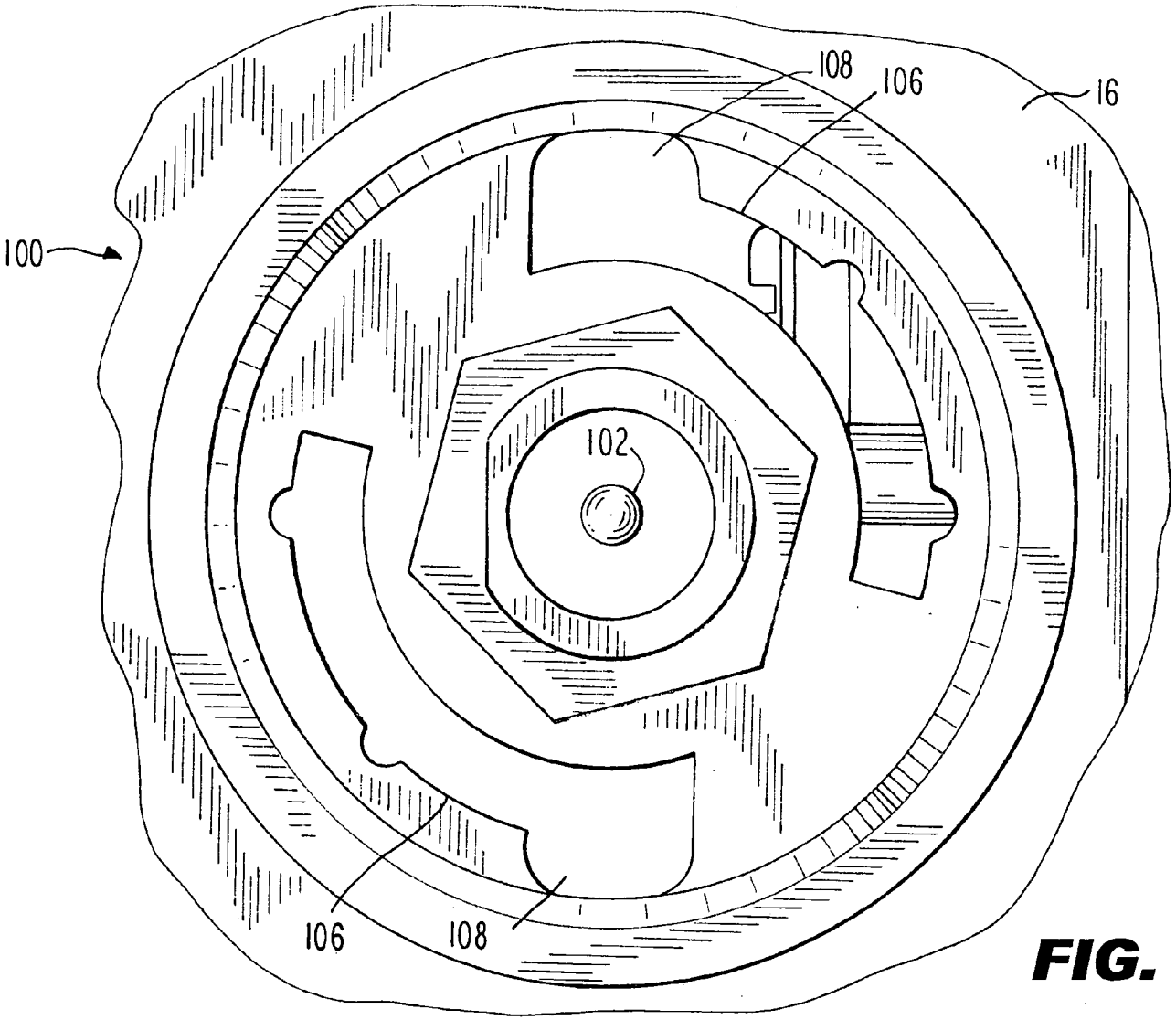
FIG. 12 is a front elevational view of a charging input port.

Referring to FIGS. 10–11, the filter housing 26 is shown in a removably mounted configuration on the body 16 of the pool cleaner 10, using the latch-and-hinge mechanism described herein, with the filter 40 disposed therein to filter the suctioned water passing through the pivotable nozzle end. The filter 40 is removably mounted to the body 16 in front of a plunger member 94 of the impeller mechanism, for example, by a friction fit of ends of the filter 40 to a filter aperture 96 in a front inner surface 98 of the body 16. The filter 40 is received in filter housing 26 and can be any known type of filter or mesh for straining particulate matter of a predetermined minimum size.

Figure 13:
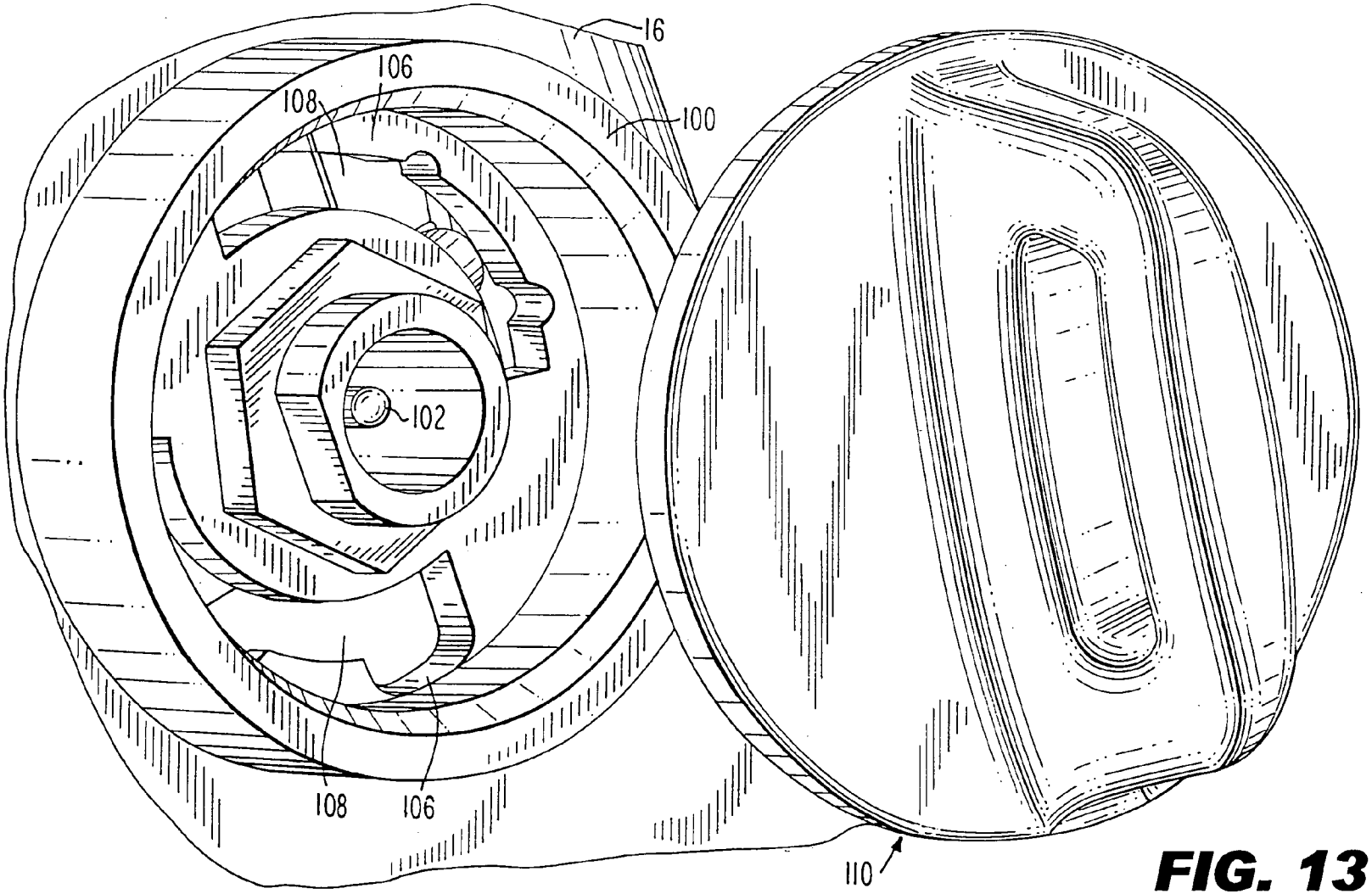
FIG. 13 is a front side perspective view of the charging input port of FIG. 12 with a protective cover unattached.
Figure 14:
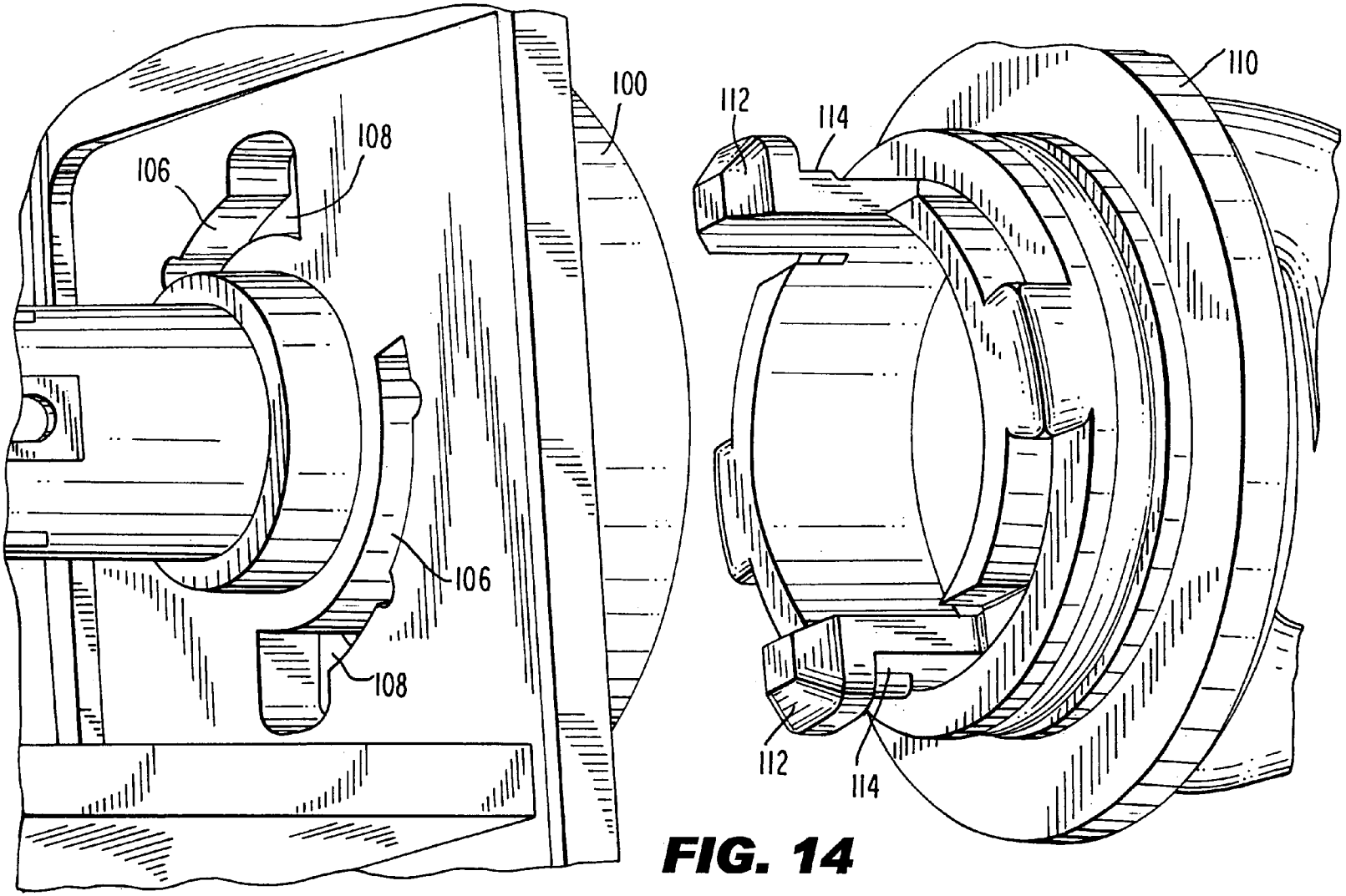
FIG. 14 is a rear side perspective view of the charging input port of FIG. 12 with a protective cover unattached.

In an alternative embodiment of the charging input port, shown in FIGS. 12–17, the charging input port 100 has a central metallic contact 102 for engaging a conductive contact of the plug 104 of the converter shown in FIG. 7. As shown in FIG. 13, a plurality of surfaces 106 and apertures 108 are provided on the body 16 of the pool cleaner 10, disposed on the sides of the central metallic contact 102. As shown in FIG. 14, a protective cover 110 includes armatures 112 for fitting into the apertures 108, and also includes a plurality of complementarily surfaces 114 for engaging and frictionally securing the protective cover 110 against the surfaces 106 on the body 16 to provide a water-tight covering of the charging input port 100.

Figure 15:
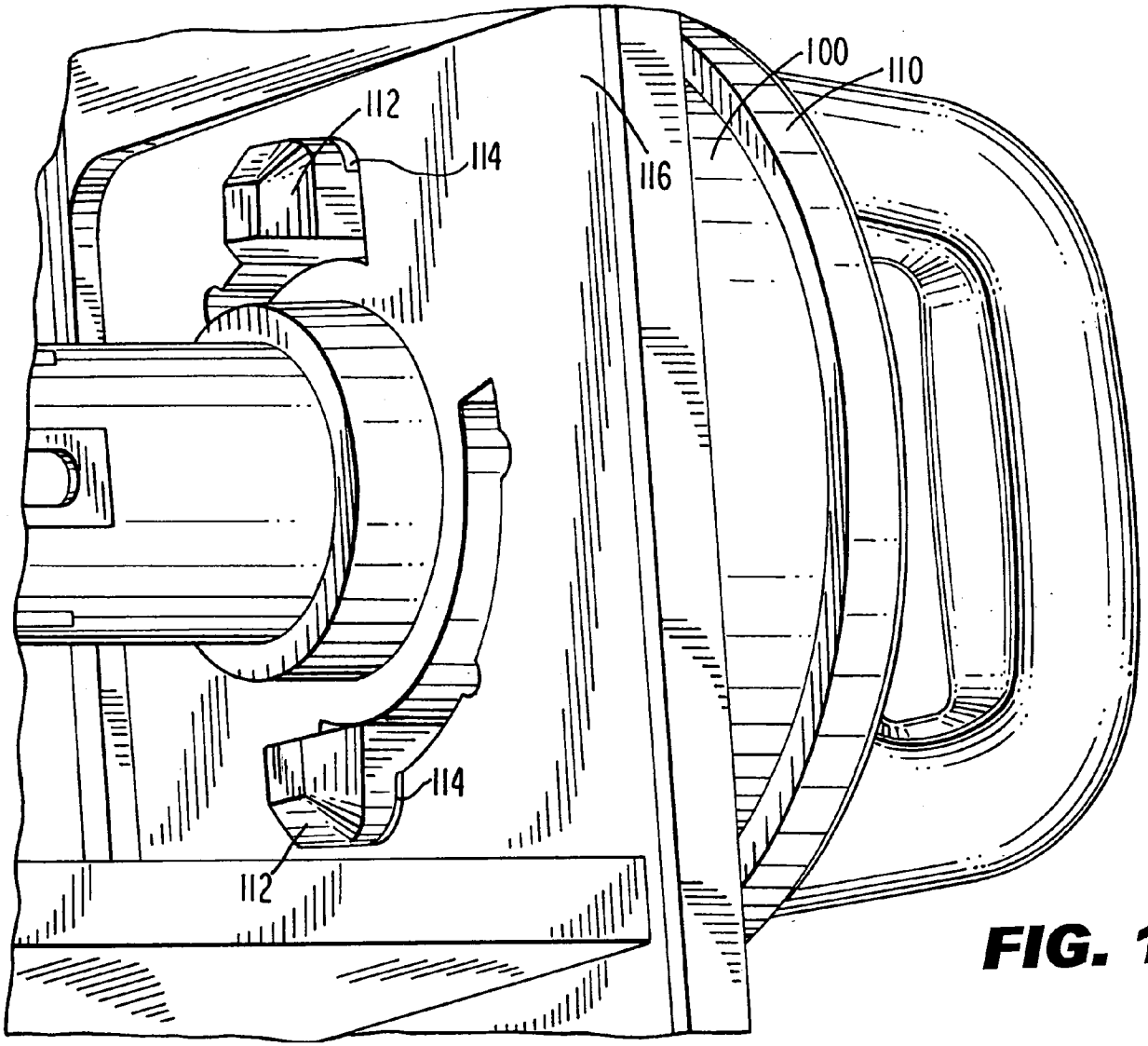
FIG. 15 is a rear side perspective view of the charging input port of FIG. 12 with a protective cover attached in a first position.
Figure 16:
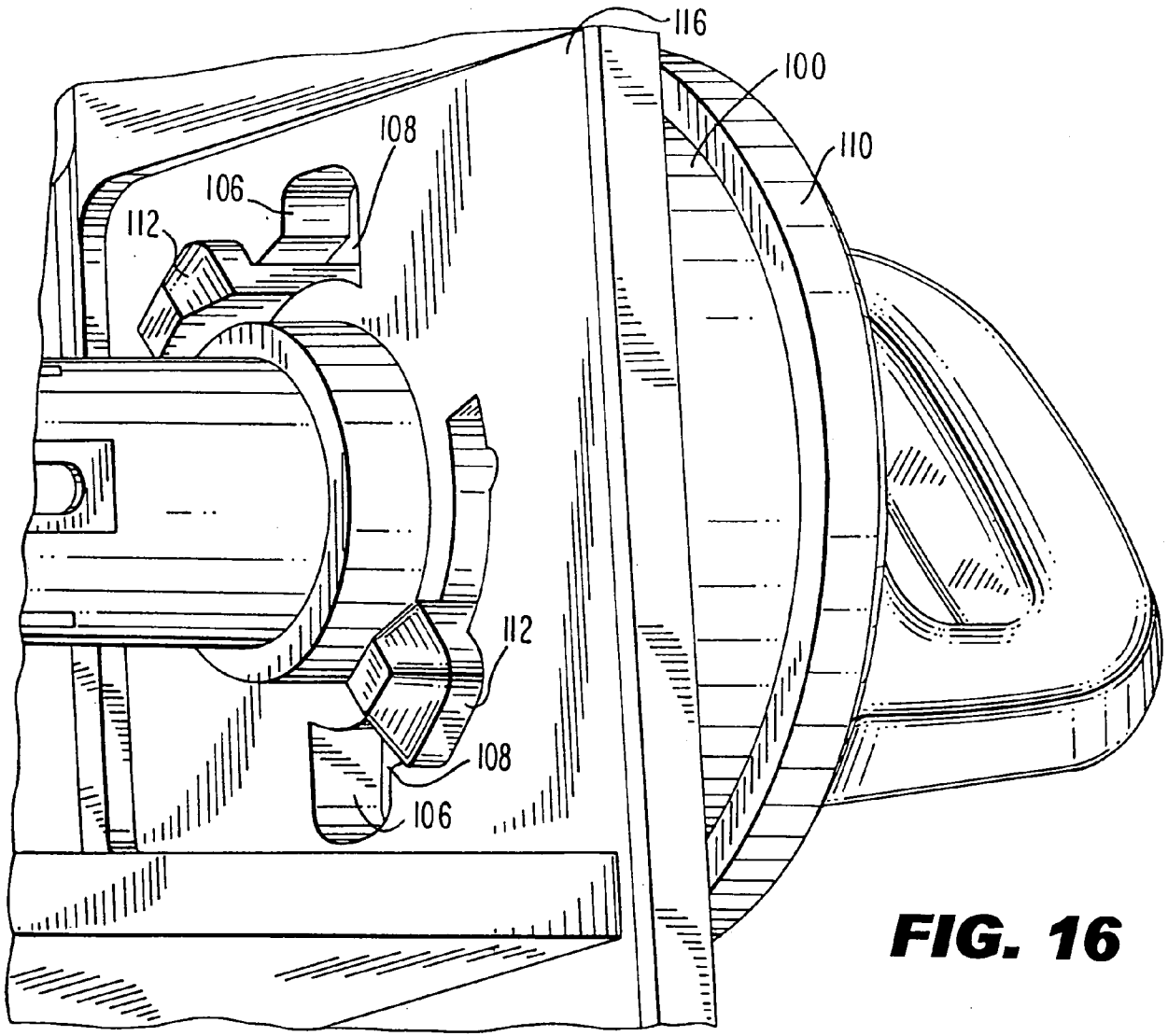
FIG. 16 is a rear side perspective view of the charging input port of FIG. 12 with a protective cover attached in a second position.
Figure 17:
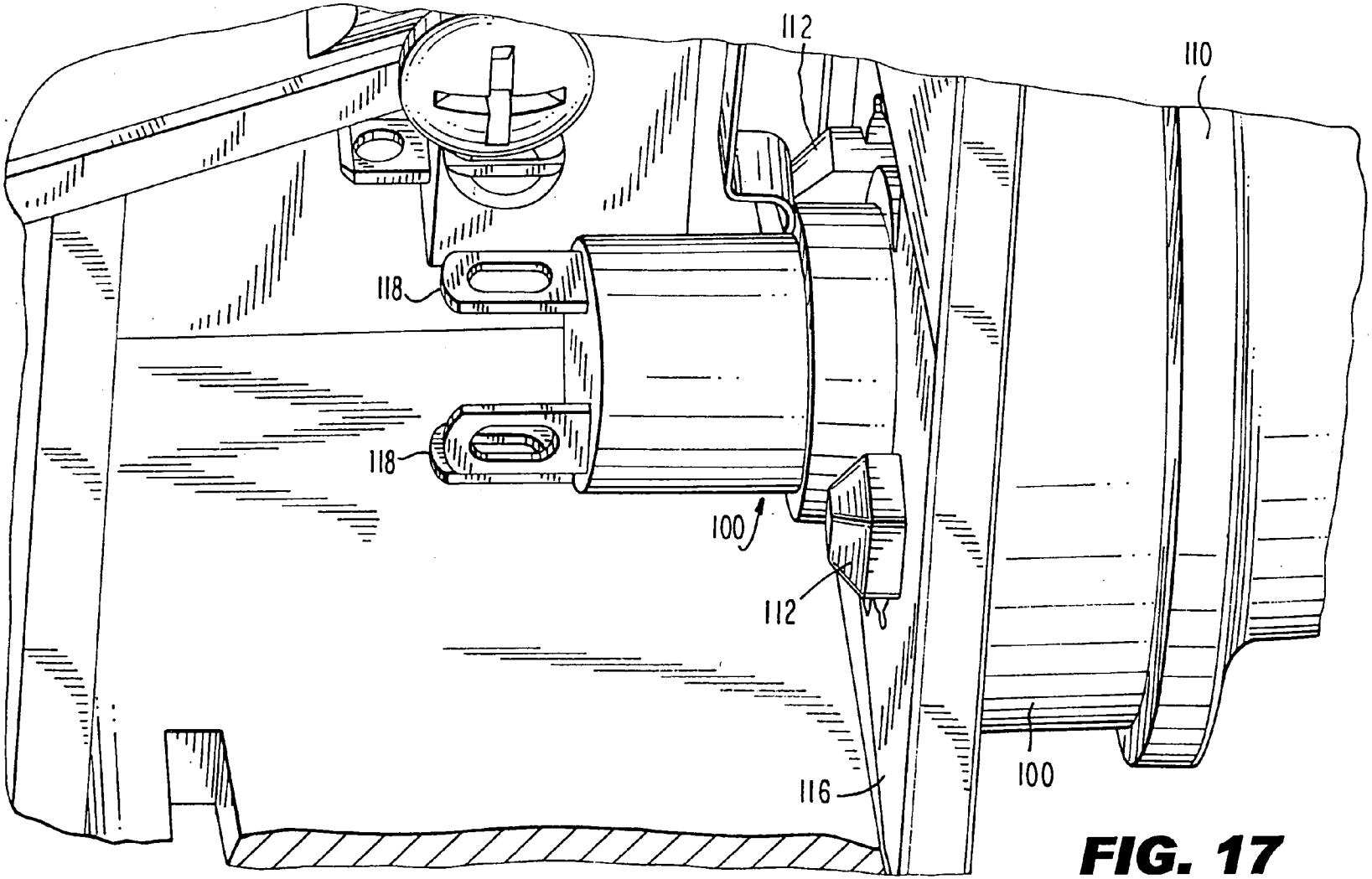
FIG. 17 is a top rear perspective view of the charging input port similar to FIG. 16.

When the protective cover 110 is initially placed into engagement with the body 16, the armatures 112 of protective cover 110 are placed in a first position in the apertures 108, as shown in FIG. 15. The apertures 108 and surfaces 106 are curved, permitting the protective cover 110 to be rotated to a second position, as shown in FIG. 16, with the armatures 112 frictionally engaging the inner surface 114 of the body 16 to provide a secure fit. Accordingly, the central metallic contact 102 shown in FIGS. 12–13 and the electrical contacts 118 from the charging input port 100 to the battery pack 84, as shown in FIG. 17, are in a water-tight setting when the protective cover 110 is secured to the charging input port 100. When the pool cleaner 10 is immersed in the pool, the central metallic contact 102 and the electrical contacts 118 are not in contact with the water and electrical shorting of the battery pack 84 is avoided.

ADDITIONAL EMBODIMENTS

As shown in FIGS. 18–38, additional embodiments of the pool cleaner of the present invention provide numerous advantages and enhancements for improved cleaning of pools and the like.

Figure 18:
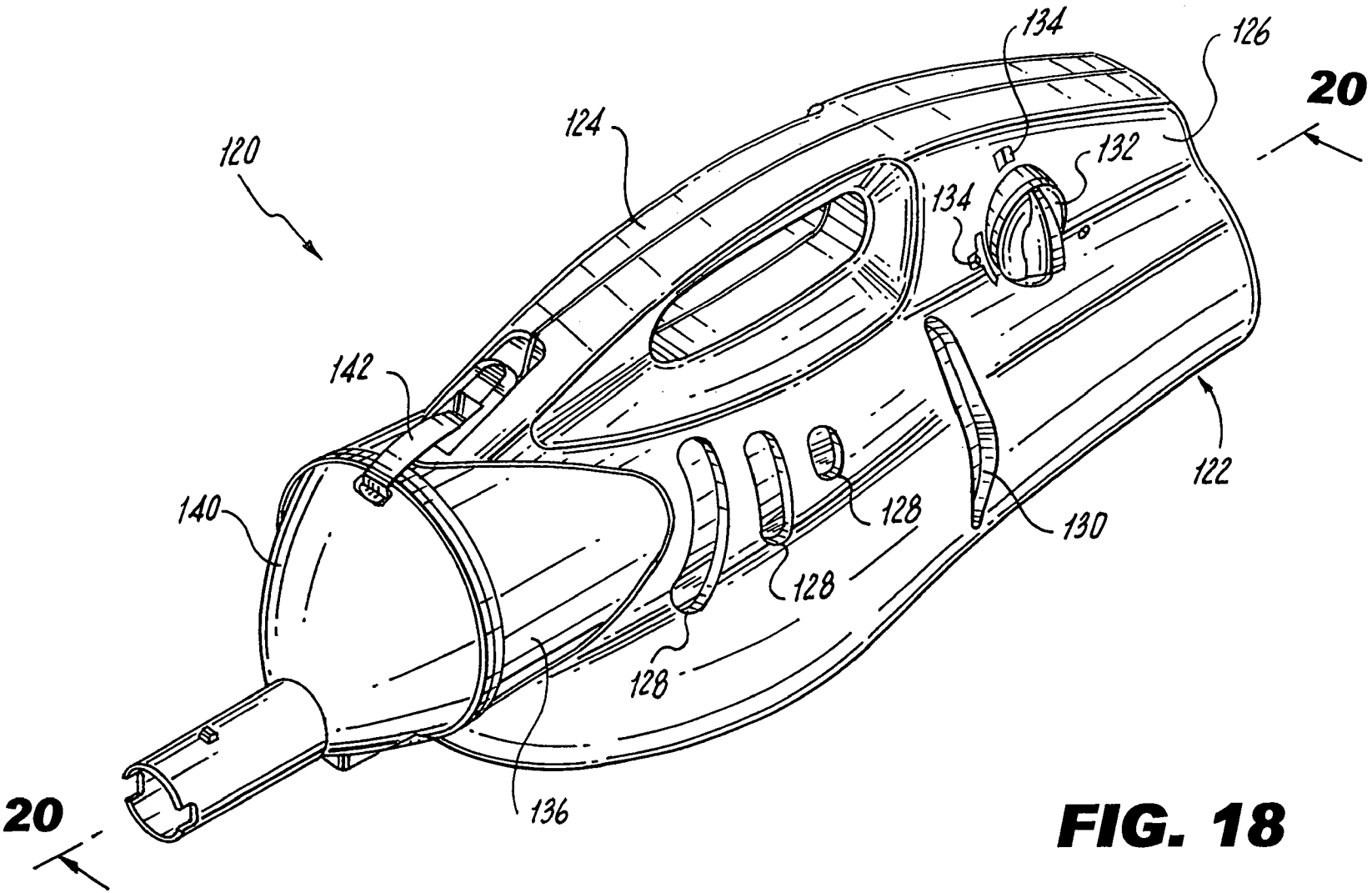
FIG. 18 is a top front side perspective view of an alternative embodiment of the pool cleaner of the present invention.

FIG. 18 is a top front side perspective view of an alternative embodiment of the pool cleaner 120 of the present invention, having a different housing configuration than the pool cleaner 10 in FIG. 1, including a shorter rear section 122 relative to the handle 124 formed in the toroidal body housing 126, a set of intake ports 128 for the inflow of water into the body housing 126 to reduce buoyancy for easier manipulation and optionally to provide a decorative appearance of the pool cleaner 120, such as having the appearance of the gills of a shark; a set of output ports 130 for the outward flow of filtered water; and an operating knob 132 located on the side of the pool cleaner 120. Indicia 134 located on the body housing 126 substantially adjacent to the knob 132 can be provided to indicate the operative positions of the knob 132 for controlling the operation of the pool cleaner 120.

The pool cleaner 120 includes a filter housing 136 for retaining a filter 138. A nozzle housing 140 is removably attached to the filter housing 136 by at least one fastener 142.

Figure 19:
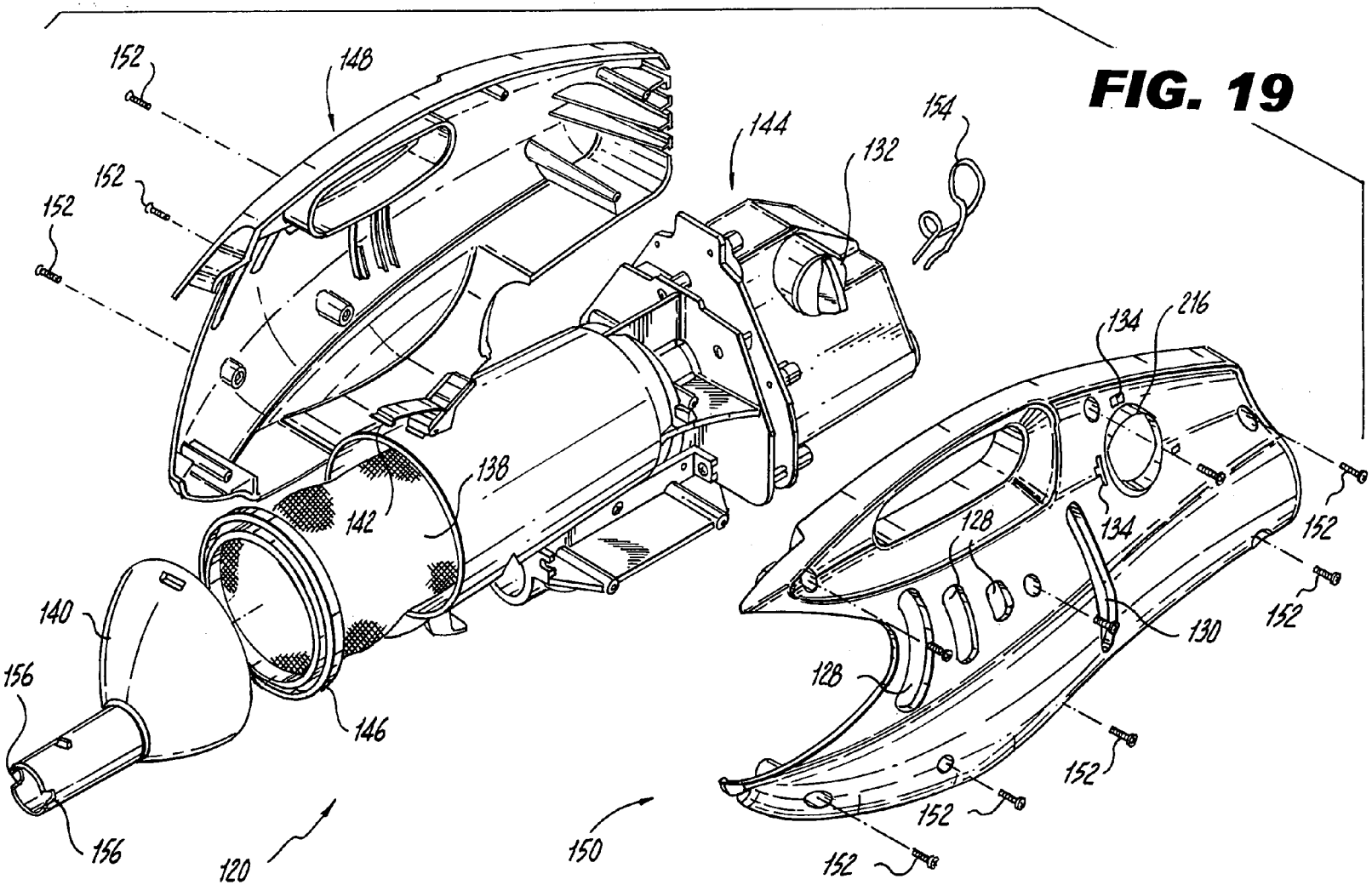
FIG. 19 is a top front side perspective exploded view with parts separated of the pool cleaner of FIG. 18.

FIG. 19 is a top front side perspective exploded view with parts separated of the pool cleaner 120 of FIG. 18, showing the filter 138 positioned within the filter housing 136 forward of the internal operating mechanism 144 of the pool cleaner 120, including the impeller described in connection with FIGS. 33–37. The filter 138 can also include a seal 146, described in connection with FIGS. 25–28, for engaging the corresponding rims of the filter housing 136 on a proximal side, and the nozzle housing 140 on the distal side, for providing a sealed configuration between the filter housing 136 and the nozzle housing 140.

The body housing 126 can be assembled from detachable halves 148, 150 which can be removably fastened together by known fasteners 152, such as screws. Other accessories can be included in the pool cleaner 120, such as a retaining cord 154 for connecting the knob 132 to the body housing 126, so that the knob 132 is removable from the body housing 126 for charging the pool cleaner 120, but the knob 132 is retained to prevent misplacement.

In addition, other accessories can include nozzle attachments as described herein which are removably mounted to the distal end of the nozzle housing 140, with at least one slot 156 engaging complementary portions of the nozzle attachments to be removably attached, for example, by a friction fit.

Customizable Housings

It is to be understood that different replaceable body housings 126 having various colors, shapes, and sizes can be provided with detachable halves 148, 150 to house the internal operating mechanism 144, so that the user can customize the appearance of the body housing 126 for any desired style or color scheme available, while retaining the basic functionality provided by the internal operating mechanism 144 mounted within the customized body housing 126.

Internal Operating Mechanism

Figure 20:
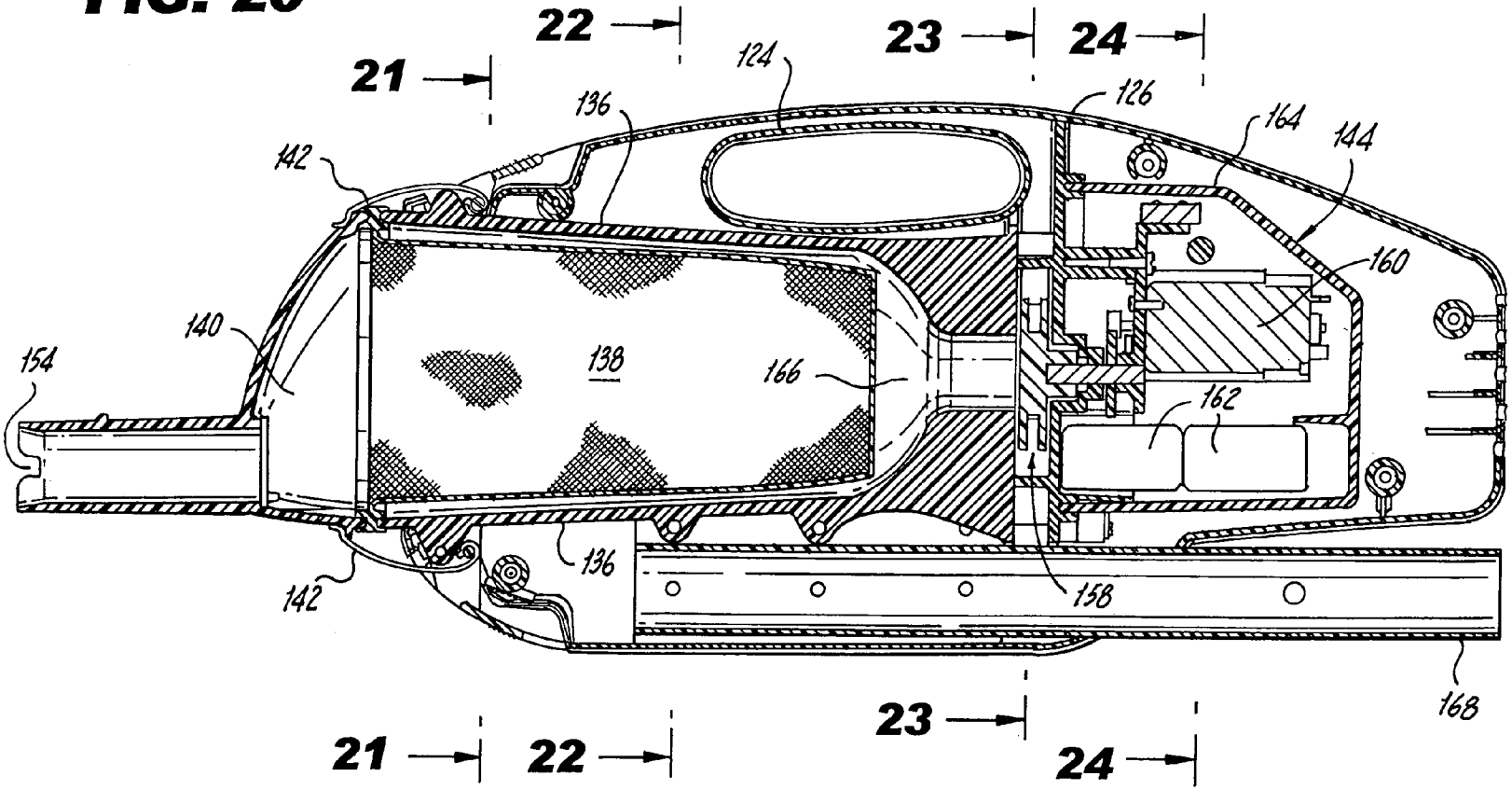
FIG. 20 is a side cross-sectional view of the pool cleaner of FIG. 18 along lines 20—20.

FIG. 20 is a side cross-sectional view of the pool cleaner 120 of FIG. 18 along lines 20—20, showing the components of the pool cleaner 120. The internal operating mechanism 144 includes an impeller 158, described in greater detail herein, which is rotated by a motor 160 powered by the batteries 162 in a sealed housing 164. The impeller 158 pulls in water through the nozzle housing 140 to be filtered by the filter 138, with the filtered water passing rearward through a connecting passage 166 and through the impeller 158 for expulsion through the output ports 130 shown in FIG. 18. As shown in FIG. 20, an optional pole attachment member 168 can be included for attaching a pole, as described herein.

Figure 21:
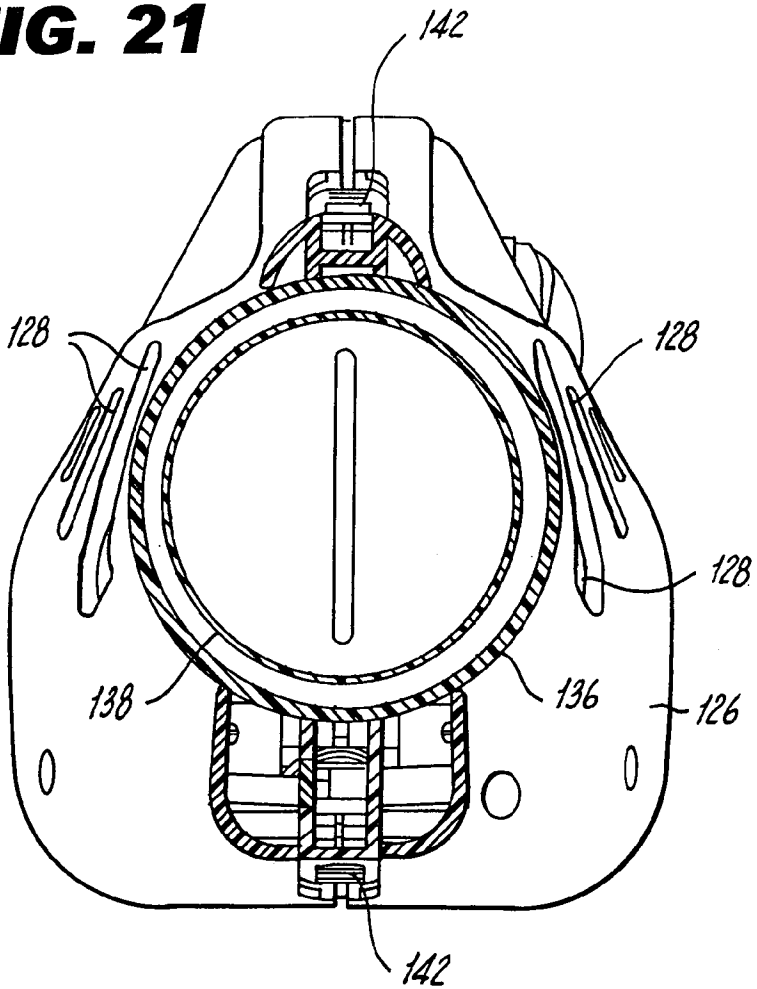
FIG. 21 is a front cross-sectional view of the pool cleaner of FIG. 18 taken along lines 21—21 of FIG. 20.

FIG. 21 is a front cross-sectional view of the pool cleaner of FIG. 18 taken along lines 21—21 of FIG. 20, showing the filter 138 disposed within the filter housing 136, and the fasteners 142 for retaining the nozzle housing 140 on the assembly of the filter 138 and the filter housing 136 mounted to the distal end of the body housing 126 having the decorative intake ports 128.

Figure 22:
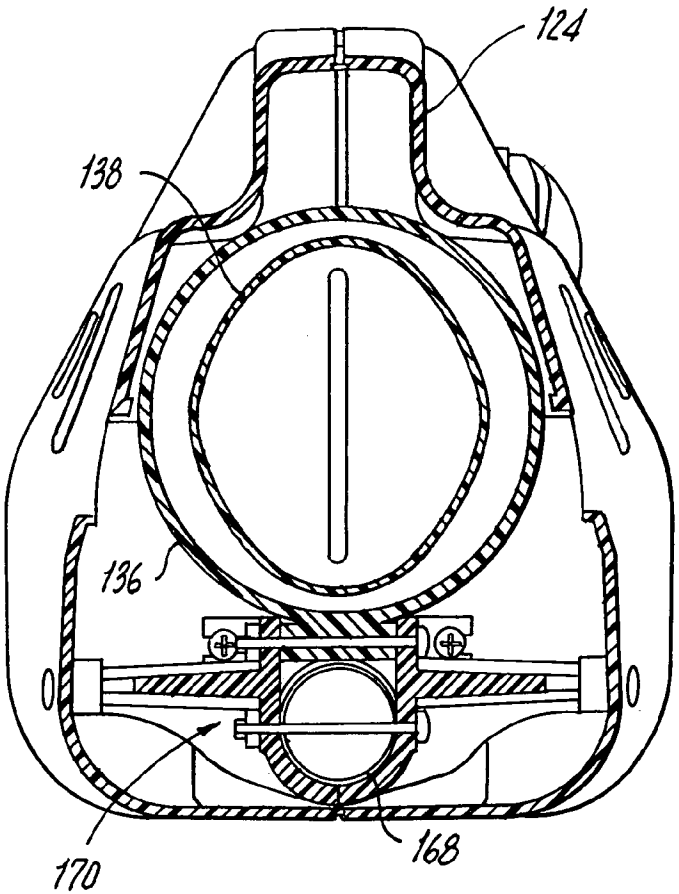
FIG. 22 is a front cross-sectional view of the pool cleaner of FIG. 18 taken along lines 22—22 of FIG. 20.

FIG. 22 is a front cross-sectional view of the pool cleaner of FIG. 18 taken along lines 22—22 of FIG. 20, showing the tapering of the filter 138 within a tapering filter housing 136. The optional pole attachment member 168 can be mounted within a mounting assembly 170 within the body housing 126.

Figure 23:
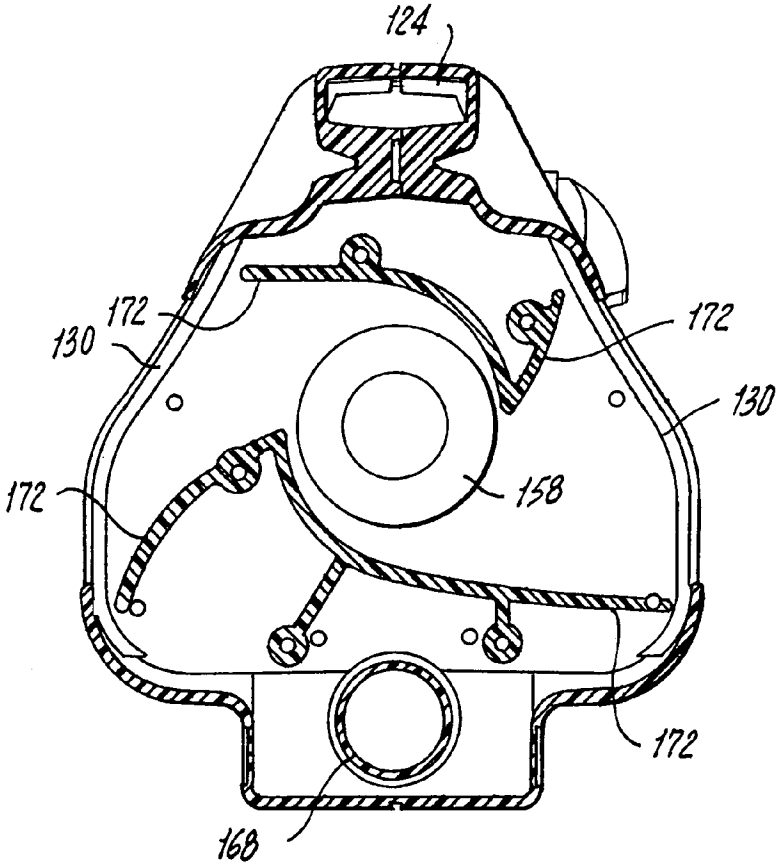
FIG. 23 is a front cross-sectional view of the pool cleaner of FIG. 18 taken along lines 23—23 of FIG. 20.

FIG. 23 is a front cross-sectional view of the pool cleaner of FIG. 18 taken along lines 23—23 of FIG. 20, showing the impeller 158 juxtaposed substantially adjacent to internal walls 172 forming channels to the output ports 130 for expelling the filtered water.

Figure 24:
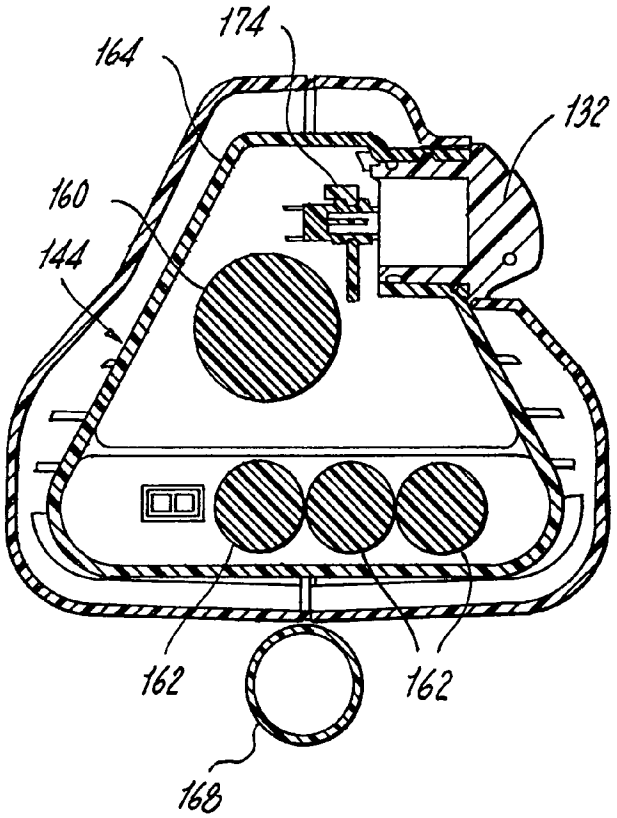
FIG. 24 is a front cross-sectional view of the pool cleaner of FIG. 18 taken along lines 24—24 of FIG. 20.

FIG. 24 is a front cross-sectional view of the pool cleaner of FIG. 18 taken along lines 24—24 of FIG. 20, showing the internal operating mechanism 144 having the motor 160 and batteries 162 disposed within the sealed housing 164, and having a switch mechanism 174 connected to the operating knob 132 and electrically connected to the motor 160 in any manner known in the art for controlling the operation of the motor 160 and the functioning of the pool cleaner 120.

Seals Engaging the Nozzle Housing and the Filter Housing

FIG. 25 is a top front side perspective view of the seal 146 of the filter 138 of the pool cleaner 120 of FIG. 18, and FIG. 26 is a side cross-sectional view of the seal 146 of FIG. 25, with the seal 146 having concentric flanges 176–182 extending both distally and proximally to form a pair of channels 184, 186 for receiving the rim 188 of the nozzle housing 140, and the rim 190 of the filter housing 136, respectively. Once the rims 188, 190 are received in their respective channels 184, 186, at least one fastener 142 can engage at least one complementary slot 192 in the nozzle housing 140 to releasably retain and secure the nozzle housing 140 to the seal 146 and so to be mounted on the body housing 126 of the pool cleaner 120. In an example embodiment, the at least one fastener 142 can be a clasp as shown in FIGS. 25–26 for moving an engaging end 194 into the complementary slot 192 to apply rearwardly directed force to the nozzle housing 140 to maintain the rim 188 within the first channel 184, and to cause the first channel 184 to be rearwardly directed to press the second channel 186 against the rim 190 of the filter housing 136.

In an alternative embodiment shown in FIGS. 27–28, FIG. 27 is a top front side perspective view and FIG. 28 is a side cross-sectional view of an alternative embodiment of a seal 196 of the filter 138 of the pool cleaner 120 of FIG. 18 with the seal 196 having a distal engagement surface 198 for engaging a rearward portion 200 of the nozzle housing 140, and with the seal 196 having a single pair of concentric flanges 202, 204 extending only proximally to form a single channel 206 for receiving the rim 190 of the filter housing 136. Once the rim 190 is received in the single channel 206, at least one fastener 142 can engage at least one complementary slot 192 in the nozzle housing 140 to releasably retain and secure the nozzle housing 140 to the seal 196 and so to be mounted on the body housing 126 of the pool cleaner 120. In an example embodiment, the at least one fastener 142 can be a clasp as shown in FIGS. 27–28 for moving the engaging end 194 into the complementary slot 192 to apply rearwardly directed force to the nozzle housing 140 to maintain the rearward portion 200 flush against the distal engagement surface 198, and to cause the seal 196 to be rearwardly directed to press the channel 206 against the rim 190 of the filter housing 136.

Operating Knob and Switch

Figure 29:
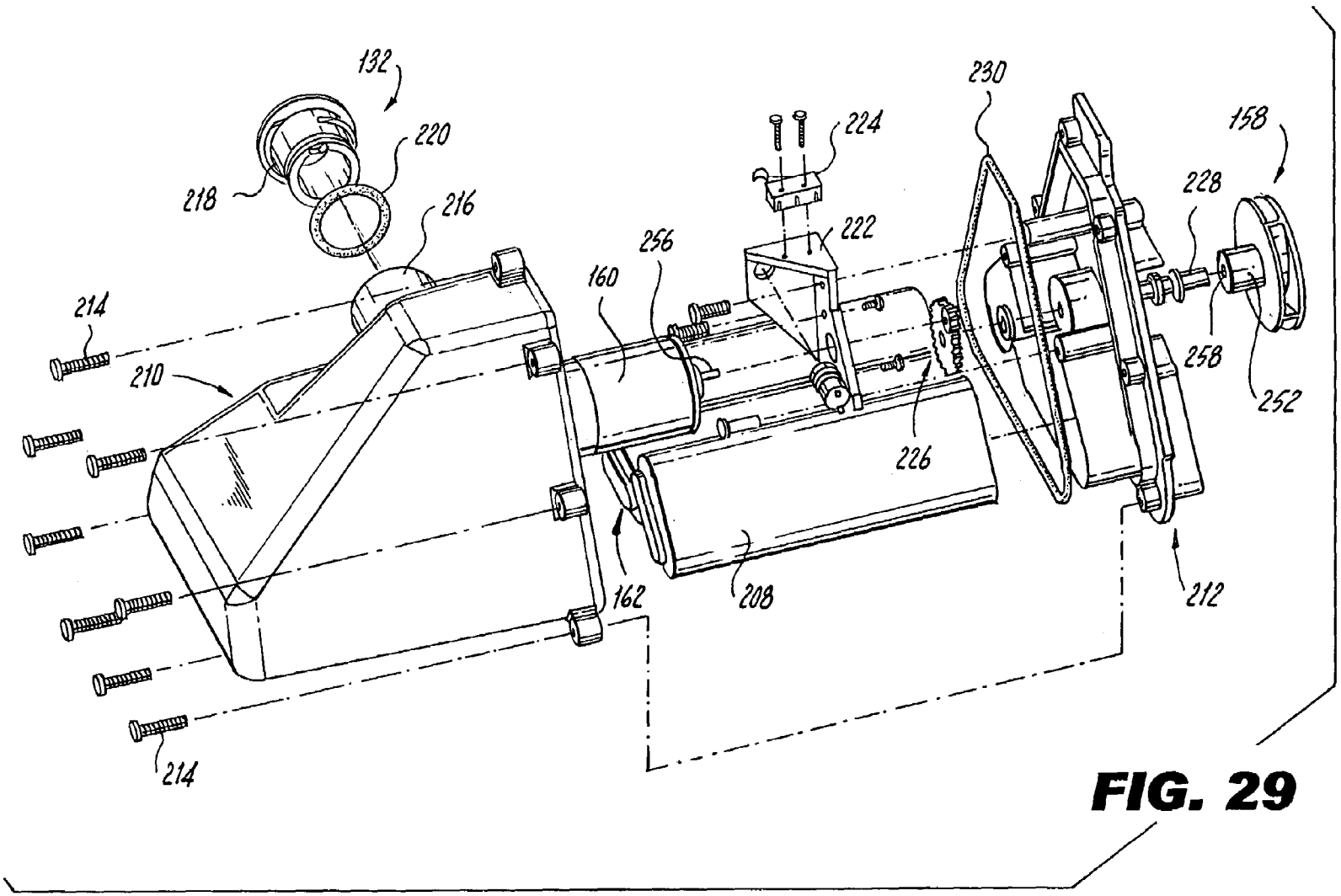
FIG. 29 is a top front side perspective exploded view with parts separated of the internal operating mechanism of the pool cleaner of FIG. 18.

FIG. 29 is a top front side perspective exploded view with parts separated of the internal operating mechanism 144 of the pool cleaner 120 of FIG. 18, with a base 208 mounted within a rearward housing 210 having a frontward plate 212 attached thereto by fasteners 214, such as screws. The rearward housing 210 includes a knob receiving slot 216, which can be a cylindrical opening into which the body 218 of the knob 132 extends into the rearward housing 210. An O-ring 220 can be included between the body 218 and the knob receiving slot 216, for example, to provide a watertight seal.

A mounting bracket 222 can be included on the base 208 for mounting a switching mechanism 224 which, when positioned with in the rearward housing 210, engages the knob 132 such that turning the knob 132 between OFF and ON positions causes electrical contact in the switching mechanism 224 to be established between the motor 160 and the batteries 162 to activate the motor 160 electrically connected thereto by known electrical circuitry. Upon activation, the motor 160 operates to turn the impeller 158, optionally via a gear assembly 226 engaging an axle 228 extending through the frontward plate 212. A seal 230 may be included between a rim of the rearward housing 210 and the frontward plate 212 to form the housing of the internal operating mechanism 144 shown in the assembled state in FIG. 19.

Figure 30:
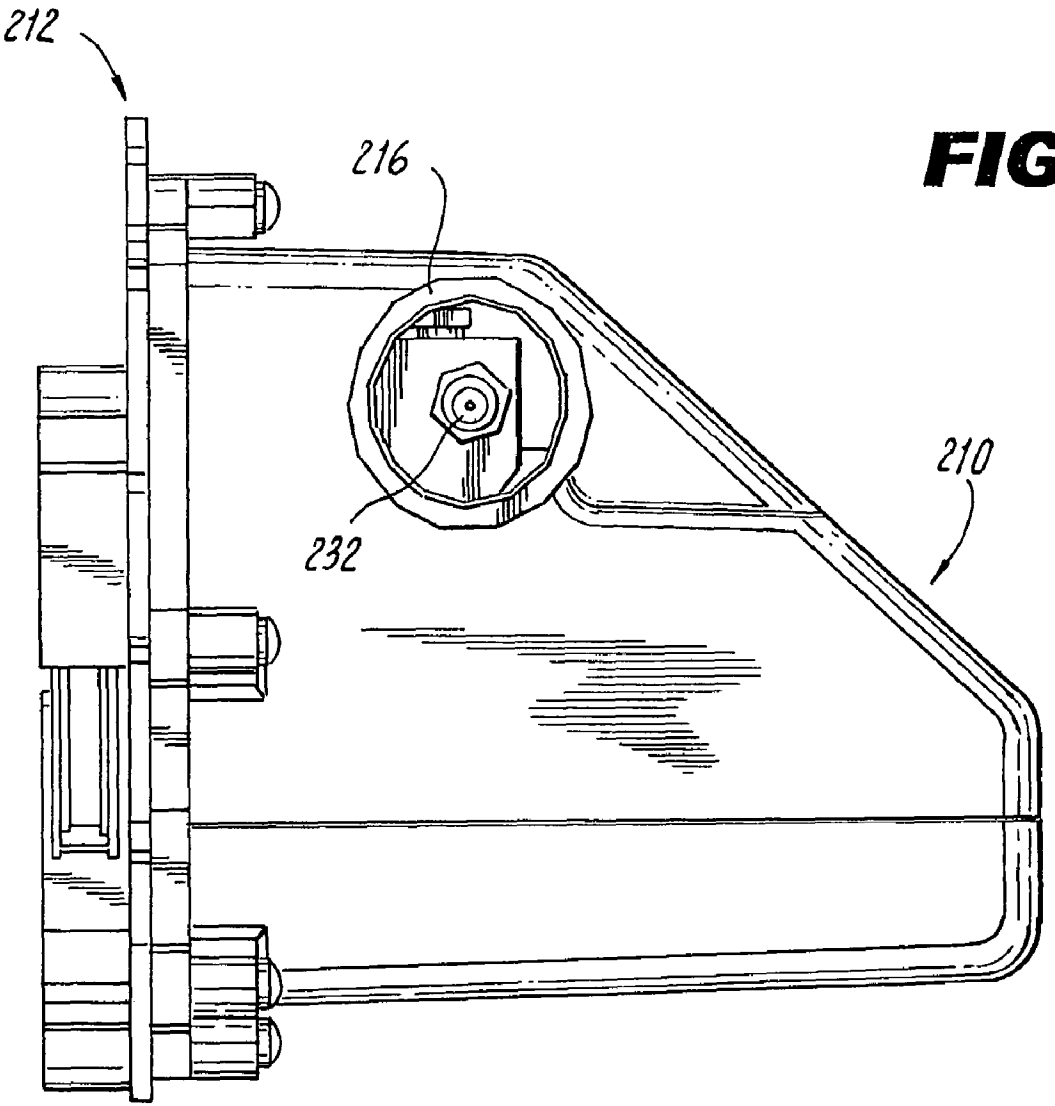
FIG. 30 is a side elevational view of a charging port of the pool cleaner of FIG. 18.

FIG. 30 is a side elevational view of a charging port 232 of the pool cleaner 120 of FIG. 18, exposed through the cylindrical knob receiving slot 216 when the knob 132 is removed, in order to electrically connect a charging device to the rechargeable batteries which can be used for the batteries 162.

Figure 31:
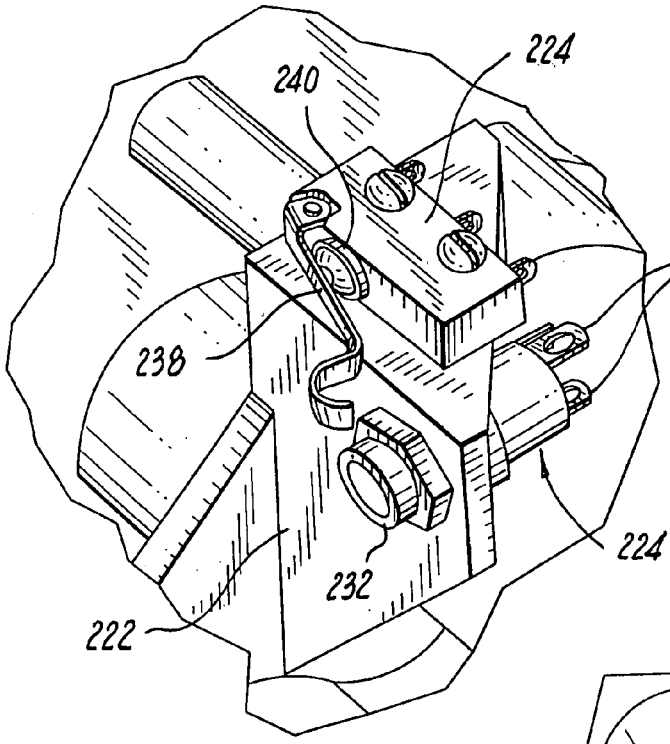
FIG. 31 is a top front side perspective view of a switch mechanism and the charging port of FIG. 30.
Figure 32:
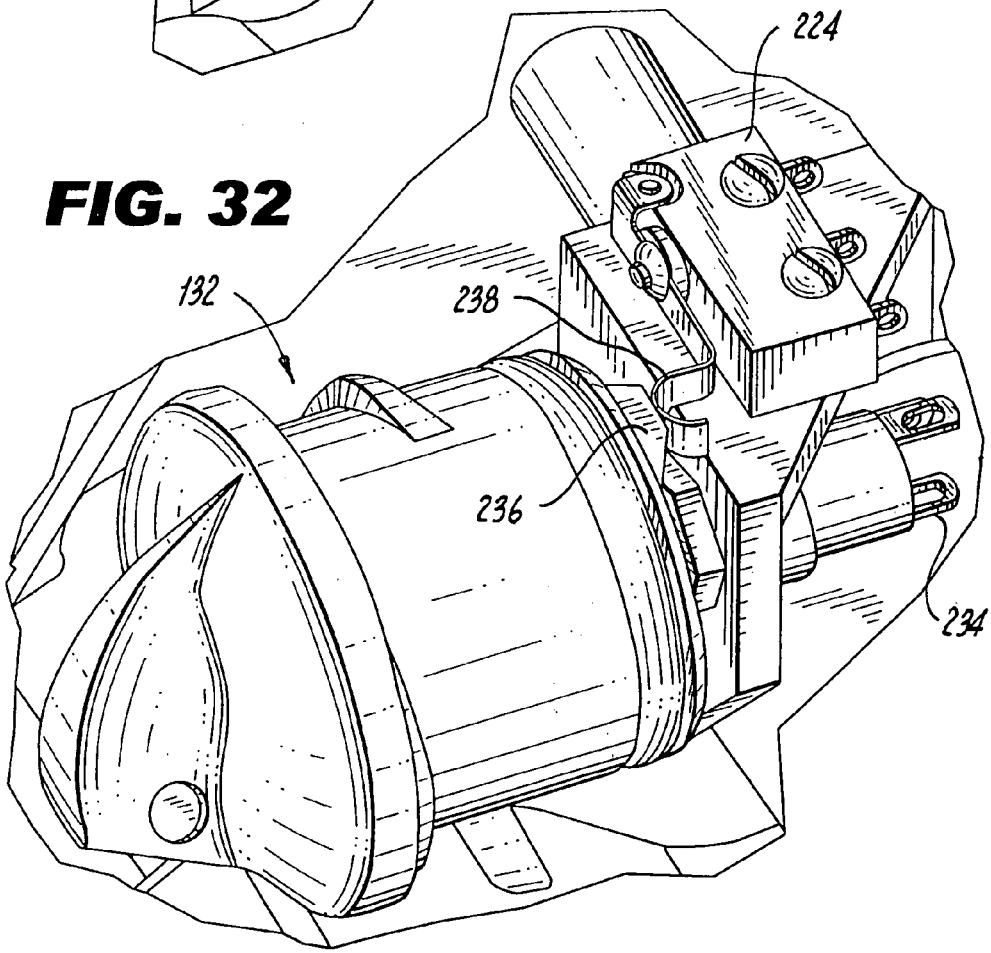
FIG. 32 is a top front side perspective view of the switch mechanism of FIG. 31 with an activation knob engaging the switch mechanism.

FIG. 31 is a top front side perspective view of the switch mechanism 224 and the charging port 232 of FIG. 30, and FIG. 32 is a top front side perspective view of the switch mechanism of FIG. 31 with the activation knob 132 engaging the switch mechanism 224. The charging port 232 has electrical contacts 234 which are connected to the batteries 162 for charging when the knob 132 is not disposed within the knob receiving slot 216. When the knob 132 is inserted into and turned within the knob receiving slot 216 to a predetermined rotational orientation corresponding to the indicia 134 indicating the ON position which is disposed on the exterior of the housing 126, an engagement surface 236 physically presses an arm 238 against a toggle switch 240 to establish an electrical connection between the batteries 162 connected to the electrical contacts and electrical contacts and/or other known circuitry of the motor 160 to activate the motor. Accordingly, the pool cleaner 120 can only be operated when the knob 132 is inserted and rotated to a predetermined position, thereby providing a safety mechanism to avoid accidental operation and electrical shorts. For example, a user cannot connect a charging device to the pool cleaner 120 while immersing the pool cleaner 120 into the water and establishing electrical shorts by activating the pool cleaner 120 in the water, since the presence of the knob 132 blocks access to the charging port 232, and no activation of the pool cleaner 120 is possible unless the knob 132 is fully rotated to the predetermined operating position.

Impeller Characteristics

As shown in FIGS. 33–37, the impeller 158 acts as a centrifugal impeller upon rotation to provide high suction and throughput of water through the pool cleaner 120 using predetermined physical dimensions described herein. The impeller 158 is configured and dimensioned to operated using the motor 160 drawing, for example, about three amps from the batteries 162 for suctioning and filtering, for example, about eight gallons per minute of pool water.

Figure 33:
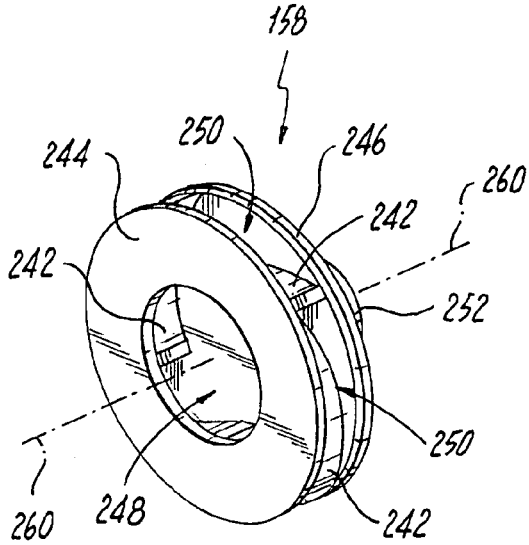
FIG. 33 is a top front side perspective view of an impeller of the pool cleaner of FIG. 18.
Figure 34:
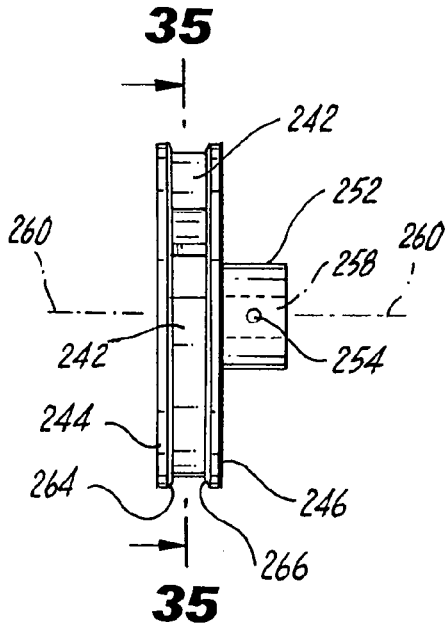
FIG. 34 is a side elevational view of the impeller of FIG. 33.
Figure 35:
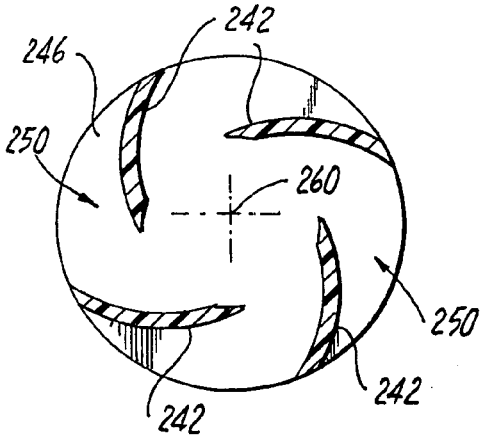
FIG. 35 is a front cross-sectional view of the impeller of FIG. 33 taken along lines 35—35.
Figure 36:
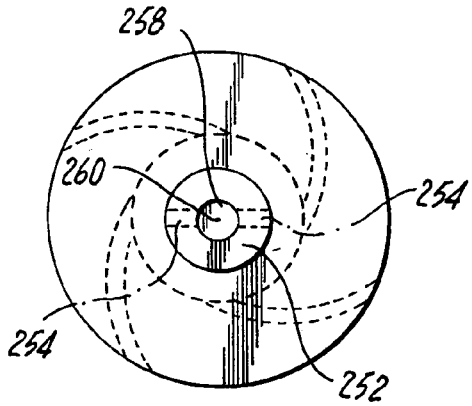
FIG. 36 is a rear cross-sectional view of the impeller of FIG. 33.

FIG. 33 is a top front side perspective view of impeller 158 of the pool cleaner 120, FIG. 34 is a side elevational view of the impeller 158 of FIG. 33, FIG. 35 is a front cross-sectional view of the impeller of FIG. 33 taken along lines 35—35; and FIG. 36 is a rear cross-sectional view of the impeller of FIG. 33. A plurality of blades 242 are mounted between a front plate 244 and a rear plate 246, with an intake opening 248 extending through the front plate 244 and connected to channels 250 formed between the blades 242 for enabling the filtered water to pass through and to be expelled through the output ports 130.

A mounting member 252 extends rearward from the rear plate 246, and can include a throughhole 254 for securing the axle 228 in FIG. 29 from the gear assembly 226, or an axle 256 extending directly from the motor 160, with the axle 228 or the axle 256 positioned within a cylindrical opening 258 extending into the mounting member 252.

Figure 37:
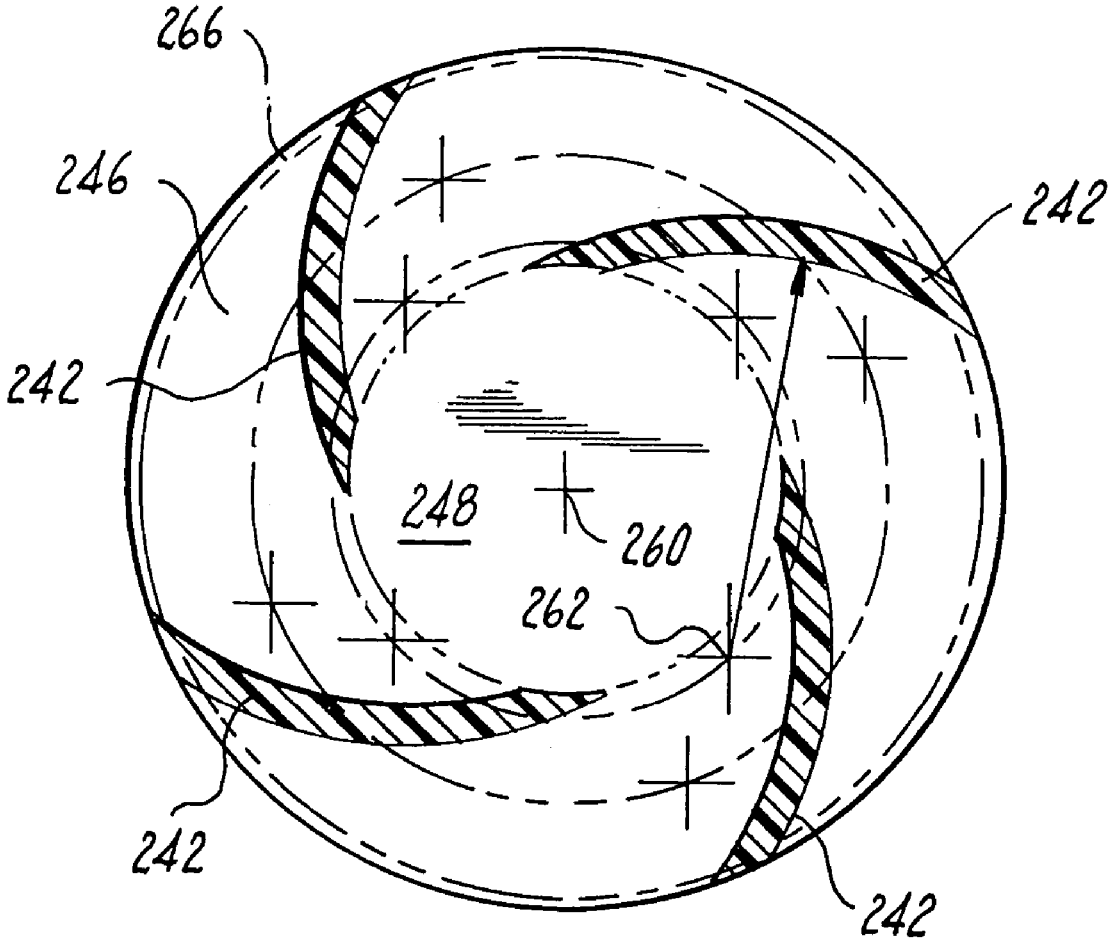
FIG. 37 is another front cross-sectional view of the impeller of FIG. 33 showing radii of curvature.

As shown in FIGS. 35–37, in a preferred embodiment, the impeller 158 includes four blades 242 equally spaced angularly about a central axis 260 of the impeller 158. As shown in greater detail in FIG. 37, which is another front cross-sectional view of the impeller 158 of FIG. 33 showing radii of curvature, the intake opening 248 has a diameter of about 1 in. (about 2.54 cm.), and each of the front plate 244 and the rear plate 246 has a diameter of about 2 in. (about 2.54 cm.). Each of the blades 242 is a substantially circular arc having a radius of curvature of about 0.932 in. (about 2.36728 cm.) extending from a center point 262, being a center of curvature, located about 0.552 in. (about 1.40208 cm.) from the central axis 260. Each blade 242 begins at the intake opening 248 and ends at the outer circumferential rim of each of the plates 244, 246. Each of the blades 242 is about 0.0625 in. (about 0.15875 cm.) thick.

Each of the plates 244, 246 can also include a beveled surface 264, 266, respectively, inwardly directed toward the blades 242, to enhance the outward flow of filtered water through the channels 250 formed between the blades 242.

Cyclonic Flow for Suction and Filtering

Figure 38:
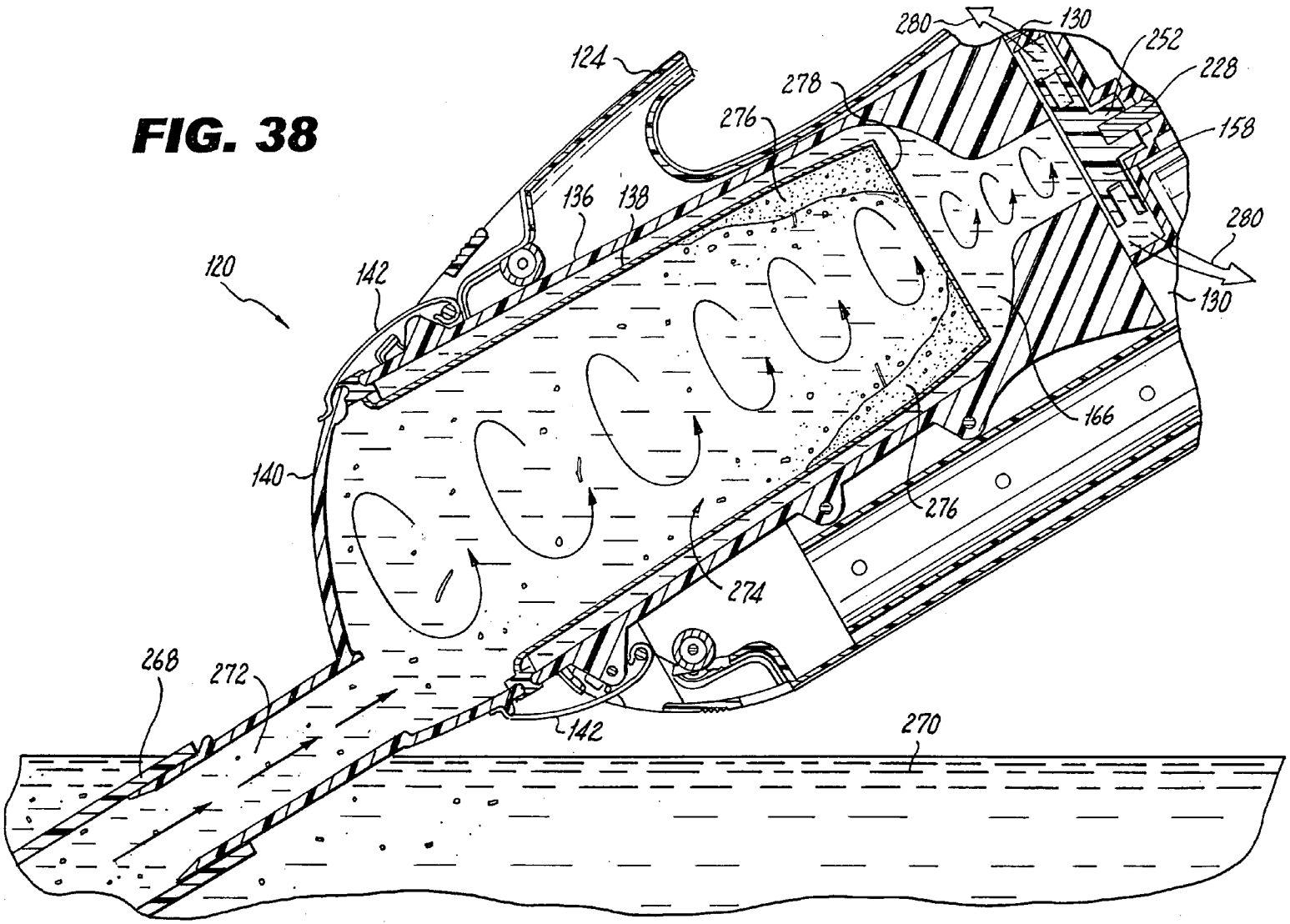
FIG. 38 is a side cross-sectional view of the pool cleaner of FIG. 18 in operation.

The configuration and design of the disclosed pool cleaner 120 provides improved suction and cleaning operations for pools. FIG. 38 is a side cross-sectional view of the pool cleaner 120 of FIG. 18 in operation, in which a nozzle attachment 268 and/or the entire pool cleaner 120 are immersed into the water 270 of the pool to be cleaned. The nozzle attachment 268 can be any known device, such as the nozzle attachment described in U.S. Ser. No. 11/139,093, filed May 26, 2005 and entitled ADAPTABLE NOZZLE ATTACHMENT FOR POOL CLEANER, which is incorporated herein by reference in its entirety. The nozzle attachment 268 can be removably secured to the nozzle housing 140 by, for example, a friction fit, to establish a contiguous passage 272 for the water 270 to be suctioned into the pool cleaner 120.

Due to the tapered shape of the filter 138 within the tapered filter housing 136 in conjunction with the tapered connecting passage 166 providing a contiguous flow to the impeller 158, the pool cleaner 120 provides a cyclonic flow 274 of the water within the filter 138, such that the debris 276 filtered by the filter 138 is more effectively retained against the inner walls of the filter 138. Therefore, more debris, such as dirt and leaves, can be retained and is compacted against the walls of the filter 138 to maximize the filtering of the debris by the filter 138, and so the filter 138 does not require removal and cleaning as often as known pool cleaning devices.

In addition, the cyclonic flow 274 causes the end section 278 of the filter 138 to remain relatively clear of debris 276, so that the suction from the impeller 158 is not substantially reduced as the debris 276 accumulates within the filter 138. Accordingly, more water 270 can be suctioned and filtered for subsequent outflow 280 through the output ports 130.

Additional Features

The disclosed pool cleaner 120 can include additional accessories and/or can be adapted with addition components and features. For example, various types of filtration grade bags can be used as the filter 138, such as finer meshes for small debris 276 in swimming pools, or courser meshes for ponds with leaves and small branches.

Other features can include at least one outside light can be mounted on the housing 126 to illuminate the surrounding water to be cleaned, such as a light on the bottom so the operator can see where the pool cleaner 120 is cleaning, which is especially useful for cleaning applications in ponds. In addition, a "bag full" light can be provided to indicate to the user when to clean the filter 138, or a light can be positioned inside the pool cleaner 120 near the filter 138 or the nozzle housing 140 to allow the user to see the dirt and debris 276 being accumulated by the pool cleaner 120.

In conjunction with or instead of the indicia 134 near the knob 132 indicating the operating state of the pool cleaner 120, the pool cleaner 120 can also include a running light to indicate when the pool cleaner 120 is on. A charge level meter and/or colored indicator lights can be used to indicate the charge capacity of the batteries 162, such as green for full charge, amber for moderate charge, and red for low charge indicating the need for recharging. Similarly, a volt meter can be used to indicate to the user how much charge is left in the batteries 162.

In addition to the customizable housing 126 using replaceable halves 148, 150 with different colors and shapes, the pool cleaner 120 can include aesthetic lights on the sides of the housing 126 for decorative effects.

Regarding the batteries 162, the pool cleaner 120 can be mounted on a charging holder or stand. Alternatively, the batteries 162 can be packaged in a removable battery pack which can be charged separately, for example, by mounting in a charger.

In addition to the handle 124, the pool cleaner 120 can include the optional pole attachment member 168 for removably mounting an elongated pole, as shown in FIG. 1. Alternatively, a telescoping or retractable handle can be included which is capable of being extended from the housing 126.

While the preferred embodiment of the present invention has been shown and described herein, it will be obvious that such embodiment is provided by way of example only. Numerous variations, changes and substitutions will occur to those skilled in the art without departing from the invention herein. Accordingly, it is intended that the invention be limited only by the spirit and scope of the appended claims.

We claim:

1. A hand-held submersible electrically-powered pool cleaner comprising:

a nozzle;

a toroidal body having:

a carrying handle for carrying manipulating and directing the cleaner during use with the carrying handle being integrally formed from an upper portion of the toroidal body and an opening through the toroidal body;

impeller means and drive motor, and a filter;

said toroidal body having an intake opening in fluid communication with the nozzle, wherein said impeller means draws pool water through the nozzle and filter to remove dirt and debris from the pool water.

2. The pool cleaner of claim 1, wherein the impeller means includes:

four blades equally spaced angularly about a central axis.

3. The pool cleaner of claim 1, wherein the impeller means includes:

a plurality of blades equally spaced angularly about a central axis, wherein each blade forms a substantially circular arc.

4. The pool cleaner of claim 1, wherein the impeller means includes:

a front plate having an impeller opening therethrough for the inflow of water;

a rear plate; and a plurality of blades equally spaced angularly about a central axis and mounted between the front and rear plates, with consecutive pairs of blades forming a respective channel in fluid communication with the impeller opening to expel the drawn in pool water.

5. The pool cleaner of claim 1, wherein the impeller means includes:

a front plate having an impeller opening therethrough having a diameter of about 1 inch for the inflow of water;

a rear plate; and four blades equally spaced angularly about a central axis, each blade forming a substantially circular arc having a center of curvature positioned about 0.552 inches from the central axis.

6. The pool cleaner of claim 1, wherein the toroidal body further includes:

a tapered filter housing, wherein the filter is disposed within the tapered filter housing; and wherein the tapered filter housing in conjunction with the impeller means draw the pool water with a cyclonic flow within the filter for maximizing the retention of the dirt and debris from the pool water.

7. The pool cleaner of claim 1, further comprising:

a nozzle housing having the nozzle attached thereto; and a filter housing; and wherein the filter includes:

a filter mesh; and a seal including a first channel for engaging a rim of the filter housing.

8. The pool cleaner of claim 7, wherein the seal includes a second channel for engaging a rim of the nozzle housing.

9. The pool cleaner of claim 1, wherein the toroidal body includes:

a housing retaining the impeller means, the drive motor, and the filter.

10. The pool cleaner of claim 9, wherein the housing is composed of a pair of removably detachable members.

11. The pool cleaner of claim 10, wherein the removably detachable members can be selective chosen by the user based on shape or color.

12. The pool cleaner of claim 9, wherein the housing includes:

a plurality of openings therethrough permitting the flow of water.

13. The pool cleaner of claim 12, wherein the plurality of openings includes at least one output port substantially adjacent to the impeller means for the outflow of filtered water therefrom.

14. The pool cleaner of claim 12, wherein the plurality of openings are decorative.

15. The pool cleaner of claim 1, further comprising:

a power source;

switch means; and an activation knob for physically contacting the switch means, wherein rotation of the activation knob to a predetermined position engages the switch means to supply power from the power source to the driver motor to activate the drive motor.

16. The pool cleaner of claim 15, further comprising:

a knob receiving slot for removably retaining the activation knob; and a charging port connected to the power source for receiving a charging device to charge the power source, wherein the charging port is positioned within the knob receiving slot such that when the activation knob is positioned therein, access to the charging port is blocked, thereby preventing charging of the power sourced during operation of the drive motor.

17. The pool cleaner of claim 15, further comprising:

indicia disposed on an exterior of the toroidal body substantially adjacent to the activation knob for indicating the predetermined position corresponding to activation of the drive motor.

18. A hand-held submersible electrically-powered pool cleaner comprising:

a nozzle;

a toroidal body having:

a carrying handle for carrying manipulating and directing the cleaner during use with the carrying handle being integrally formed from an upper portion of the toroidal body and an opening through the toroidal body;

an impeller and drive motor, and a tapered filter housing;

a filter disposed within the tapered filter housing;

said toroidal body having an intake opening in fluid communication with the nozzle, wherein said impeller means draws pool water through the nozzle and filter to remove dirt and debris from the pool water; and wherein the tapered filter housing in conjunction with the impeller draw the pool water with a cyclonic flow within the filter for maximizing the retention of the dirt and debris from the pool water.

19. A hand-held submersible electrically-powered pool cleaner comprising:

a nozzle housing having a nozzle;

a toroidal body having:

a carrying handle for carrying manipulating and directing the cleaner during use with the carrying handle being integrally formed from an upper portion of the toroidal body and an opening through the toroidal body;

an impeller and drive motor; and a filter housing; and a filter having:

a filter mesh; and a seal including a first channel for engaging a rim of the filter housing;

said toroidal body having an intake opening in fluid communication with the nozzle, wherein said impeller means draws pool water through the nozzle and filter to remove dirt and debris from the pool water.

20. The pool cleaner of claim 19, wherein the seal includes a second channel for engaging a rim of the nozzle housing.

* * * * *